US007205080B2

(12) United States Patent
Iwasaki et al.

(10) Patent No.: US 7,205,080 B2
(45) Date of Patent: Apr. 17, 2007

(54) ARYLAMINE COMPOUND, CHARGE TRANSPORT MATERIAL, ELECTROPHOTOGRAPHIC PHOTORECEPTOR, IMAGE FORMING APPARATUS AND PROCESS CARTRIDGE

(75) Inventors: Masahiro Iwasaki, Kanagawa (JP); Katsumi Nukada, Kanagawa (JP); Mieko Seki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 363 days.

(21) Appl. No.: 10/895,338

(22) Filed: Jul. 21, 2004

(65) Prior Publication Data

US 2005/0069796 A1 Mar. 31, 2005

(30) Foreign Application Priority Data

Jul. 25, 2003 (JP) ..... P2003-280460

(51) Int. Cl.
*G03G 5/05* (2006.01)

(52) U.S. Cl. ..... 430/58.75; 430/72; 430/73; 399/159

(58) Field of Classification Search ..... 430/73, 430/72, 58.75; 564/305; 399/159
See application file for complete search history.

(56) References Cited

U.S. PATENT DOCUMENTS

| | | | | |
|---|---|---|---|---|
| 4,047,948 | A | 9/1977 | Horgan | |
| 4,299,897 | A | 11/1981 | Stolka et al. | |
| 5,389,481 | A * | 2/1995 | Saita et al. | 430/58.15 |
| 5,804,344 | A * | 9/1998 | Mitsumori | 430/58.5 |

FOREIGN PATENT DOCUMENTS

| | | |
|---|---|---|
| JP | A 47-30330 | 11/1972 |
| JP | A 61-132955 | 6/1986 |
| JP | A 3-138654 | 6/1991 |
| JP | A 4-189873 | 7/1992 |
| JP | A 4-290851 | 10/1992 |
| JP | A 5-43813 | 2/1993 |
| JP | A 5-98181 | 4/1993 |
| JP | A 5-140472 | 6/1993 |
| JP | A 5-140473 | 6/1993 |
| JP | A 5-263007 | 10/1993 |
| JP | A 5-279591 | 10/1993 |
| JP | A 6-11854 | 1/1994 |
| JP | A 7-36203 | 2/1995 |
| JP | A 8-176293 | 7/1996 |
| JP | A 8-208820 | 8/1996 |

OTHER PUBLICATIONS

Tanaka et al., "Hybrid sol-gel coating with dispersed fluoropolymer latex," Preprints of 8th Polymer Materials Forum, pp. 89, 1999.

* cited by examiner

*Primary Examiner*—John L Goodrow
(74) *Attorney, Agent, or Firm*—Oliff & Berridge, PLC

(57) ABSTRACT

An arylamine compound represented by formula (1).

(I)

$Ar_1$ represents a phenyl group substitued by a substituted or unsubstituted monovalent polycyclic aromatic hydrocarbon group, and a substituted or unsubstituted monovalent heterocyclic group. $Ar_2$ represents a substituted or unsubstituted arylene group. $R_1$ represents a hydrogen atom, a halogen atom, an alkoxy group, or a substituted or unsubstituted alkyl group. $R_2$ represents a hydrogen atom, a substituted or unsubstituted alkyl group, or a substituted or unsubstituted aryl group. $R_3$ and $R_4$ each independently represents a hydrogen atom, a substituted or unsubstituted alkyl group, or a substituted or unsubstituted aryl group, at least one of $R_3$ and $R_4$ represents a substituted or unsubstituted aryl group, and $R_3$ and $R_4$ may be bound to form a ring via a single bond or a divalent group. m represents an integral of from 0 to 4.

12 Claims, 8 Drawing Sheets

ARYLAMINE COMPOUND, CHARGE TRANSPORT MATERIAL, ELECTROPHOTOGRAPHIC PHOTORECEPTOR, IMAGE FORMING APPARATUS AND PROCESS CARTRIDGE

BACKGROUND OF THE INVENTION

1. Field of the Invention

The present invention relates to an arylamine compound, a charge transport material, an electrophotographic photoreceptor, an image forming apparatus, and a process cartridge.

2. Description of the Related Art

A photosensitive receptor having a photosensitive layer mainly containing an organic photoconductive compound has been actively studied owing to various advantages thereof, for example, it is relatively easily produced, is inexpensive, and is easy to handle, and is excellent in thermal stability, in comparison to the conventional photoreceptor mainly containing an inorganic photoconductive material (such as, selenium, zinc oxide, cadmium sulfide and silicon) having been used in the art. In particular, a photoreceptor having a function-separated photosensitive layer with an accumulated layers has been put into practical use, in which the charge generation function and the charge transport function are borne by separated functional layers, and a material having the former generation function is contained in the charge generation layer, whereas a material having the later charge transport function is contained in the charge transport layer.

There is such a possibility in this system that a substance having a large charge generation efficiency is used as the charge generation material, and a substance having a large charge transport efficiency is used in combination thereto as the charge transport material, whereby a electrophotographic photoreceptor having high sensitivity can be obtained. Low molecular weight compounds have been mainly used as the charge transport material, which are generally used after dissolving in an organic solvent along with a suitable binder resin, followed by coating. The system is preferred since the property of the coated layer and the photosensitive characteristics can be controlled to a certain extent by selecting the kind and the compositional ratio of the binder resin. However, in order to form a uniform organic thin film that does not suffer deposition of crystals or formation of pinholes, it is necessary to select a charge transport material having high compatibility to the binder resin.

Furthermore, it is important that charge injection from the charge generation material to the charge transport material, i.e., charge injection from the charge generation layer to the charge transport layer, is effectively carried out though the charge generation material and the charge transport material have good characteristics. The charge injection cannot be determined unconditionally among the substances since it depends on the characteristics of the interface between the charge generation material (or the charge generation layer) to the charge transport material (or the charge transport layer). As having been described, the charge transport material is demanded to satisfy various conditions, and thus charge transport materials having various characteristics have been developed.

Among them, a tetraarylbenzidine compound has been earnestly studied owing to the high charge mobility (as described, for example, in U.S. Pat. No. 4,047,948, U.S. Pat. No. 4,299,897, JP-A-61-132955, JP-A-62-267749 and JP-A-3-138654). Among the tetraarylbenzidine compounds, one having a styryl group as a substituent has been known (as described, for example, in JP-A-4-290851, JP-A-6-11854 and JP-A-7-36203).

SUMMARY OF THE INVENTION

The tetraarylbenzidine compound having a styryl group is inferior in compatibility with a binder resin and solubility in a coating solvent although it has a relatively high charge mobility. The tetraarylbenzidine compound having a styryl group is still unsatisfactory due to poor image maintenance property, such as fogging and image defects, and poor durability.

An object of the invention is to provide such a styryl group-containing arylamine compound that can be used as a charge transport material and is excellent in compatibility and film forming property upon applying to an electrophotographic photoreceptor. The invention is also to provide such an electrophotographic photoreceptor that has high sensitivity and fast responsiveness and is excellent in repetition stability, and such an image forming apparatus and process cartridge that can provide good image quality for a long period of time.

The present invention has been made in view of the above circumstances.

According to a first aspect of the invention, an arylamine compound is represented by formula (I).

(I)

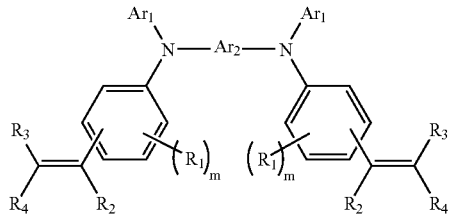

$Ar_1$ represents a phenyl group substitued by —$R_5$—COO—$R_6$, a substituted or unsubstituted monovalent polycyclic aromatic hydrocarbon group, and a substituted or unsubstituted monovalent heterocyclic group. $Ar_2$ represents a substituted or unsubstituted arylene group. $R_1$ represents a hydrogen atom, a halogen atom, an alkoxy group, or a substituted or unsubstituted alkyl group. $R_2$ represents a hydrogen atom, a substituted or unsubstituted alkyl group, or a substituted or unsubstituted aryl group. $R_3$ and $R_4$ each independently represents a hydrogen atom, a substituted or unsubstituted alkyl group, or a substituted or unsubstituted aryl group, at least one of $R_3$ and $R_4$ represents a substituted or unsubstituted aryl group, and $R_3$ and $R_4$ may be bound to form a ring via a single bond or a divalent group. $R_5$ represents an alkylene group having 1 to 4 carbon atoms. $R_6$ represents an alkyl group having 1 to 4 carbon atoms. m represents an integral of from 0 to 4.

According to a second aspect of the invention, an arylamine compound is represented by formula (I-1).

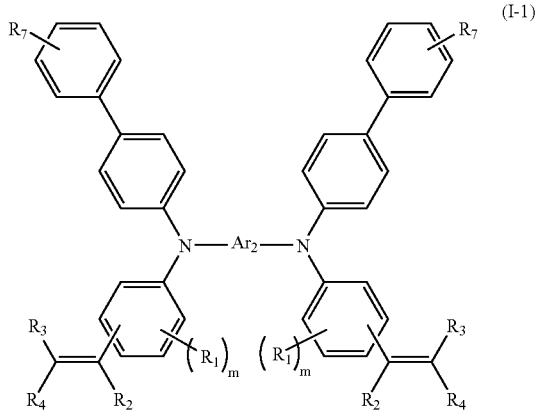

(I-1)

$Ar_2$ represents a substituted or unsubstituted arylene group. $R_1$ represents a hydrogen atom, a halogen atom, an alkoxy group, or a substituted or unsubstituted alkyl group. $R_2$ represents a hydrogen atom, a substituted or unsubstituted alkyl group, or a substituted or unsubstituted aryl group. $R_3$ and $R_4$ each independently represents a hydrogen atom, a substituted or unsubstituted alkyl group, or a substituted or unsubstituted aryl group, at least one of $R_3$ and $R_4$ represents a substituted or unsubstituted aryl group, and $R_3$ and $R_4$ may be bound to form a ring via a single bond or a divalent group. $R_7$ represents a hydrogen atom, a halogen atom, an alkoxy group, or a substituted or unsubstituted alkyl group. m represents an integral of from 0 to 4.

The aforementioned arylamine compound can be used as a charge transport material, and an electrophotographic photoreceptor can be provided by using the arylamine compound. In other words, the invention provides such an electrophotographic photoreceptor containing a conductive support having formed thereon a photosensitive layer containing the arylamine compound.

The photosensitive layer of the electrophotographic photoreceptor may be a single-layer photosensitive layer containing both a charge generation material and a charge transport material in one layer or a function-separated photosensitive layer having a layer containing a charge generation material and a layer containing a charge transport material separately provided as being adjacent to each other. The photosensitive layer may contain the aforementioned arylamine compound as the charge transport material. As the charge generation material, at least one of oxytitanium phthalocyanine, chlorogallium phthalocyanine and hydroxygallium phthalocyanine may be used. The electrophotographic photoreceptor may have a protective layer as the outermost layer (i.e., the layer at the farthest position from the conductive support), and the protective layer preferably includes a siloxane based resin, which has a charge transport property and a cross-linked structure.

An image forming apparatus and a process cartridge can be provided by using the aforementioned electrophotographic photoreceptor. The image forming apparatus preferably contains the electrophotographic photoreceptor; a charging unit which charges the electrophotographic photoreceptor; an exposure unit which exposes the charged electrophotographic photoreceptor to from an electronic latent image; a developing unit which develops the electronic latent image to form a toner image; and a transferring unit which transfers the toner image to a recording medium. The process cartridge preferably contains the electrophotographic photoreceptor; and at last one unit selected from the group consisting of a charging unit which charges the electrophotographic photoreceptor, an exposure unit which exposes the charged electrophotographic photoreceptor to form an electronic latent image, and a cleaning unit which cleans the electrophotographic photoreceptor.

The arylamine compound of the invention is such a styryl group-containing arylamine compound that can be used as a charge transport material and exerts high sensitivity and excellent compatibility with a binder resin upon applying to an electrophotographic photoreceptor. The electrophotographic photoreceptor of the invention has a uniform coating film, is suppressed in residual potential fluctuation upon repeated use, and exerts excellent environment maintenance property, owing to the use of the arylamine compound. The image forming apparatus and the process cartridge of the invention provide good image quality for a long period of time and attain reduction in environmental load and substantial cost reduction, owing to the use of the electrophotographic photoreceptor.

DETAILED DESCRIPTION OF THE PREFERRED EMBODIMENTS

Figure 1:
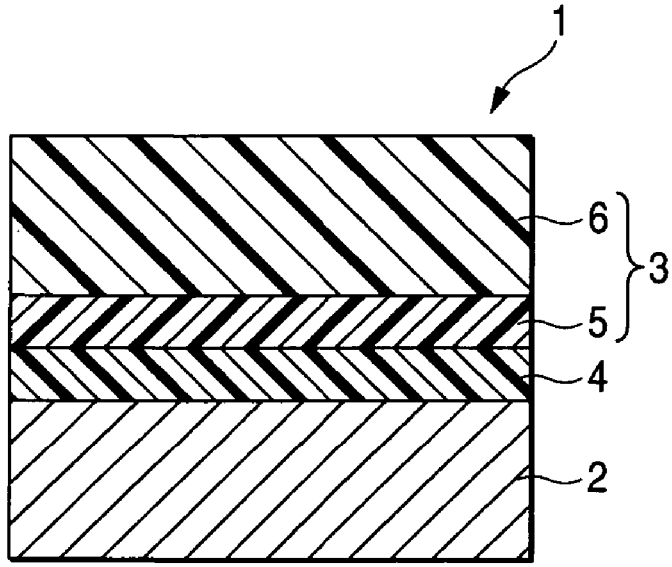
FIG. 1 is a schematic cross sectional view showing an electrophotographic photoreceptor according to a first embodiment of the invention.

Embodiments for carrying out the invention will be described with reference to the drawings. In the drawings, the same elements are attached with the same symbols to omit duplicate explanation.

(Arylamine Compound)

The invention provides an arylamine compound represented by formula (I) and preferably an arylamine compound represented by formula (I-1).

(I)

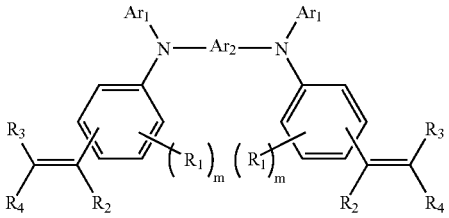

(I-1)

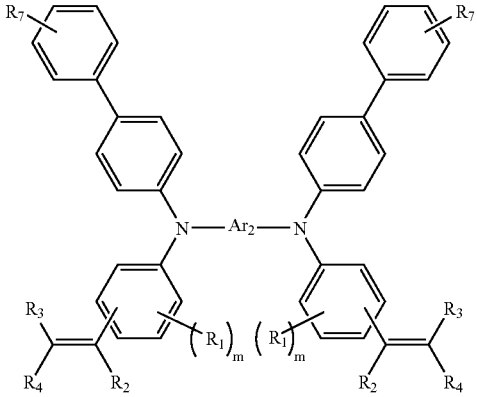

Preferred examples of the group represented by $Ar_1$ in the aryl amine compound represented by formula (I) will be described.

The phenyl group substituted by $—R_5—COO—R_6$ is represented by formula (Ar1-1). In formula (Ar1-1), $R_5$ preferably represents an alkylene group having from 1 to 3 carbon atoms, and more preferably represents an alkylene group having 1 or 2 carbon atoms. $R_6$ preferably represents an alkyl group having from 1 to 3 carbon atoms, more preferably represents an alkyl group having 1 or 2 carbon atoms, and further preferably represents a methyl group.

(Ar1-1)

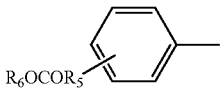

A substituted or unsubstituted monovalent condensed-ring polycyclic hydrocarbon group, which is preferred as the substituted or unsubstituted monovalent polycyclic aromatic hydrocarbon group, preferably has 2 or 3 benzene rings, and particularly preferably groups represented by formula (Ar1-2), (Ar1-3) and (Ar1-4). In following formulae, $R_9$, $R_{10}$ and $R_{11}$ each independently represents a hydrogen atom, an alkyl group having 1 to 4 carbon atoms, an alkoxy group having 1 to 4 carbon atoms or a halogen atom.

(Arl-2)

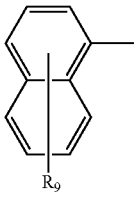

-continued (Arl-3)

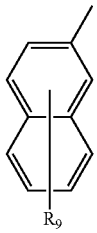

(Arl-4)

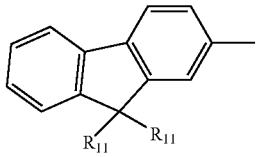

A biphenyl group substituted by a substituted or unsubstituted phenyl group, which is preferred as the substituted or unsubstituted monovalent polycyclic aromatic hydrocarbon group, includes a group represented by formula (Ar1-5). A biphenyl group substituted by an alkyl group having 1 to 4 carbon atoms, an alkoxy group having 1 to 4 carbon atoms or a halogen atom, includes a group represented by formula (Ar1-6). In following formulae, R7 represents a hydrogen atom, a halogen atom, an alkoxy group or a substituted or unsubstituted alkyl group, and preferably a hydrogen atom, a halogen atom, an alkoxy group having 1 to 4 carbon atoms or an alkyl group having 1 to 4 carbon atoms.

(Arl-5)

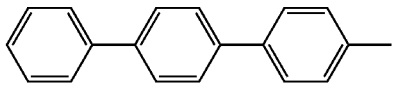

(Arl-6)

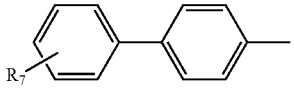

A substituted or unsubstituted monovalent condensed-ring heterocyclic group, which is preferred as the substituted or unsubstituted monovalent heterocyclic group, is preferably a group represented by formula (Ar1-7). A monovalent heterocyclic compound group, in which at least one 3- to 6-membered heterocyclic ring and at least one benzene ring are bound via a single bond or a divalent group (such as an alkylene group having 1 to 3 carbon atoms, an alkenylene group having 1 to 3 carbon atoms, —O—, —CO— and —COO—), which is preferred as the substituted or unsubstituted monovalent heterocyclic group, is preferably those having a sulfur atom as the hetero atom, examples of which include groups represented by formulae (Ar1-8) and (Ar1-9).

(Arl-7)

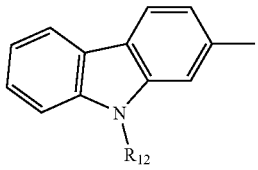

-continued (Arl-8)

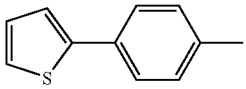

(Arl-9)

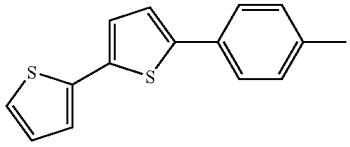

In the aforementioned groups represented by $Ar_1$, a group represented by formula (Ar1-6) (a group having a biphneyl skeleton) and a group represented by formula (Ar1-4) (a group having a fluorene skeleton) are particularly preferred owing to the high mobility upon using the compound as a charge transport material.

Preferred examples of the group represented by $Ar_2$ in the aryl amine compound represented by formulae (I) and (I-1) will be described.

A substituted or unsubstituted phenylene group, which is preferred as $Ar_2$, includes a group represented by formula (Ar2-1). A substituted or unsubstituted divalent condensed-ring polycyclic hydrocarbon group, which is preferred as $Ar_2$, includes groups represented by following formulae (Ar2-2), (Ar2-3) and (Ar2-4). In following formulae, $R_{13}$, $R_{15}$, $R_{16}$ and $R_{20}$ each independently represents a hydrogen atom, an alkyl group having 1 to 4 carbon atoms, an alkoxy group having 1 to 4 carbon atoms, a substituted or unsubstituted phenyl group, a substituted or unsubstituted aralkyl group or a halogen atom.

(Ar2-1)

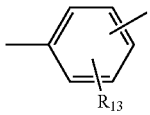

(Ar2-2)

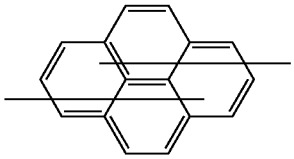

(Ar2-3)

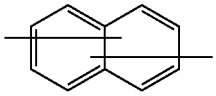

(Ar2-4)

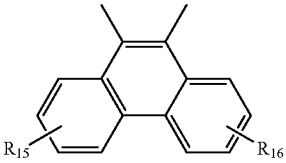

(Ar2-5)

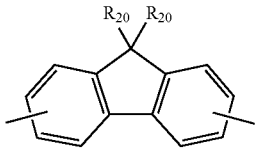

A substituted or unsubstituted divalent condensed-ring heterocyclic group, which is preferred as $Ar_2$, includes a group represented by formula (Ar2-6) A divalent group in which two substituted or unsubstituted phenyl groups are bound via a single bond or a divalent group, which is preferred as $Ar_2$, includes a group represented by formula (Ar2-7). In formulae (Ar2-6) and (Ar2-7), $R_{14}$, $R_{17}$, $R_{18}$ and $R_{19}$ each independently represents a hydrogen atom, an alkyl group having 1 to 4 carbon atoms, an alkoxy group having 1 to 4 carbon atoms, a substituted or unsubstituted phenyl group, a substituted or unsubstituted aralkyl group or a halogen atom.

(Ar2-6)

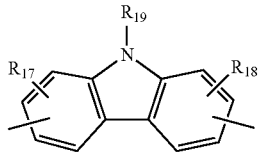

(Ar2-7)

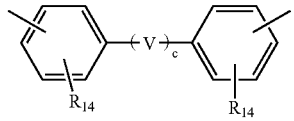

In formula (Ar2-7), c represents 0 or 1, and the case where c is 0 means a single bond. In the case where c is 1, V represents one of groups represented by formulae (V-1) to (V-11). In the following formulae, d represents an integer of from 1 to 10. e represents an integer of from 1 to 3.

(V-1)

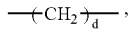

(V-2)

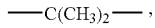

(V-3)

(V-4)

(V-5)

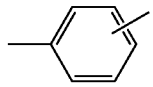

(V-6)

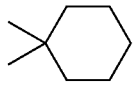

(V-7)

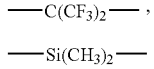

(V-8)

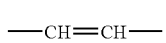

(V-10)

(V-11)

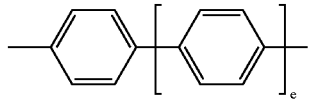

In the aforementioned groups represented by $Ar_2$, a group (a group having a biphneyl skeleton), which represented by formula (Ar2-7) and is a group in the case where c is 0, is particularly preferred owing to the high mobility upon using the compound as a charge transport material.

Preferred examples of the groups represented by $R_1$, $R_2$, $R_3$ and $R_4$ in the aryl amine compound represented by formulae (I) and (I-1) will be described.

$R_1$ preferably represents a hydrogen atom, a halogen atom (such as chlorine and fluorine), an alkoxy group having 1 to 4 carbon atoms (such as a methoxy group, an ethoxy group, a propoxy group and a butoxy group), or a substituted or unsubstituted alkyl group having 1 to 4 carbon atoms (such as a methyl group, an ethyl group, a propyl group, an isopropyl group and a butyl group).

$R_2$ preferably represents a hydrogen atom, a substituted or unsubstituted alkyl group having 1 to 4 carbon atoms (such as a methyl group, an ethyl group, a propyl group, an isopropyl group and a butyl group), or an aryl group having 6 to 12 carbon atoms (such as a phenyl group, a 2-methylphenyl group, a 3-methylphenyl group and a 4-methylphenyl group), and among these, a hydrogen atom is particularly preferred.

$R_3$ and $R_4$ each independently preferably represents a hydrogen atom, a substituted or unsubstituted alkyl group (such as a methyl group, an ethyl group, a propyl group, an isopropyl group and a butyl group), or an aryl group, provided that at least one of $R_3$ and $R_4$ represents a substituted or unsubstituted aryl group (such as a phenyl group, a 3-methylphenyl group, a 4-methylphenyl group, a 3-ethylphenyl group, a 4-ethylphenyl group, a 3-propylphenyl group, a 4-propylphenyl group, a 3-isopropylphenyl group, a 4-isopropylphenyl group, a 3-t-butylphenyl group, a 4-t-butylphenyl group, a 3-n-butylphenyl group, a 4-n-butylphenyl group, a 3-methoxyphenyl group, a 4-methoxyphenyl group, a 3-ethoxyphenyl group and a 4-ethoxyphenyl group).

$R_3$ and $R_4$ may be bound via a single bond or a divalent group to form a ring, and the divalent group is preferably an alkylene group having 1 to 3 carbon atoms or an alkenylene group having 1 to 3 carbon atoms. The structure of the ring formed by binding $R_3$ and $R_4$ via a single bond or a divalent group include the following structures (a) to (e). The carbon-carbon double bond, to which $R_3$ and $R_4$ are bonded, is in the following structure.

(a)

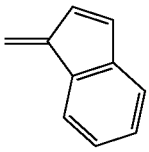

(b)

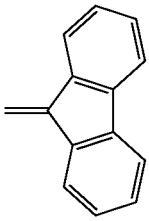

-continued (c)

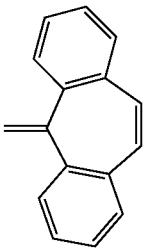

(d)

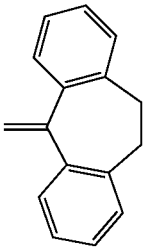

(e)

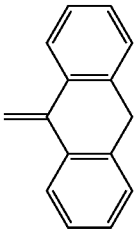

The arylamine compound represented by formula (I) or (I-1) has two vinyl groups substituted by $R_2$, $R_3$ and $R_4$, and the positions on the benzene rings where the vinyl groups are substituted are preferably the same as each other. In other words, both the two vinyl groups are preferably substituted at the o-position, the m-position or the p-position of the benzene rings with respect to the position where the nitrogen atom is bonded.

The arylamine compound also has two groups represented by $R_1$, and the positions on the benzene ring where the groups represented by $R_1$ are substituted are also preferably the same as each other. In other words, both the groups represented by $R_1$ are preferably substituted at the o-position, the m-position or the p-position of the benzene rings with respect to the position where the nitrogen atom is bonded.

The two vinyl groups substituted by $R_2$, $R_3$ and $R_4$ are preferably substituted at the p-positions, and the groups represented by $R_1$ preferably substituted at the m-positions.

Specific examples of the arylamine compound represented by formula (I) or (I-1) (Compounds 1 to 64) will be shown in Tables 1 to 8 below. The term "position of vinyl group" in the tables means the substitution position of the vinyl group substituted by $R_2$, $R_3$ and $R_4$.

TABLE 1

| Compound | $Ar_1$ | $Ar_2$ | m | $R_1$ | $R_2$ | $R_3$ | $R_4$ | Position of vinyl group |
|---|---|---|---|---|---|---|---|---|
| 1 | $CH_2CH_2COOCH_3$ | | 0 | — | —H | —H | | p-position |
| 2 | $CH_2CH_2COOCH_3$ | | 0 | — | —H | —H | $CH_3$ | p-position |
| 3 | $CH_2CH_2COOCH_3$ | | 0 | — | —H | | | p-position |
| 4 | $CH_2CH_2COOCH_3$ | $H_3C$ $CH_3$ | 0 | — | —H | —H | | p-position |
| 5 | $CH_2CH_2COOCH_3$ | $H_3C$ $CH_3$ | 0 | — | —H | —H | $CH_3$ | p-position |
| 6 | $CH_2CH_2COOCH_3$ | $H_3C$ $CH_3$ | 0 | — | —H | | | p-position |
| 7 | $CH_2CH_2COOCH_3$ | | 0 | — | —H | —H | $CH_3$ | p-position |
| 8 | | | 0 | — | —H | —H | | p-position |

TABLE 2

| Compound | $Ar_1$ | $Ar_2$ | m | $R_1$ | $R_2$ | $R_3$ | $R_4$ | Position of vinyl group |
|---|---|---|---|---|---|---|---|---|
| 9 | | | 0 | — | —H | —H | $CH_3$ | p-position |
| 10 | | | 0 | — | —H | —H | $CH_3$ | p-position |
| 11 | | | 0 | — | —H | —H | $CH_3$ $CH_3$ | p-position |
| 12 | | | 0 | — | —H | | | p-position |
| 13 | | | 1 | m-position CH3— | —H | —H | $CH_3$ | p-position |

TABLE 2-continued

| Compound | $Ar_1$ | $Ar_2$ | m | $R_1$ | $R_2$ | $R_3$ | $R_4$ | Position of vinyl group |
|---|---|---|---|---|---|---|---|---|
| 14 | | | 1 | m-position CH3— | —H | —H | | p-position |
| 15 | | | 0 | — | —H | —H | | p-position |
| 16 | | | 0 | — | —H | —H | | p-position |

TABLE 3

| Compound | $Ar_1$ | $Ar_2$ | m | $R_1$ | $R_2$ | $R_3$ | $R_4$ | Position of vinyl group |
|---|---|---|---|---|---|---|---|---|
| 17 | | | 0 | — | —H | —H | | p-position |
| 18 | | | 0 | — | —H | —H | | p-position |
| 19 | | | 0 | — | —H | | | p-position |
| 20 | | | 0 | — | —H | —H | | p-position |
| 21 | | | 0 | — | —H | —H | | p-position |
| 22 | | | 0 | — | —H | —H | | p-position |
| 23 | | | 0 | — | —H | —H | | p-position |
| 24 | | | 0 | — | —H | —H | | p-position |

TABLE 4
| Compound | $Ar_1$ | $Ar_2$ | m | $R_1$ | $R_2$ | $R_3$ | $R_4$ | Position of vinyl group |
|---|---|---|---|---|---|---|---|---|
| 25 | 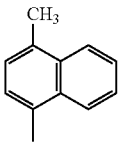 | 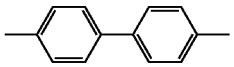 | 0 | — | —H | —H | 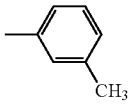 | p-position |
| 26 | 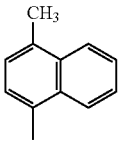 | 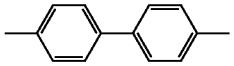 | 0 | — | —H | —H | 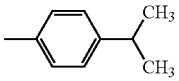 | p-position |
| 27 | 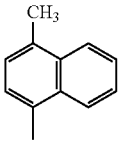 | 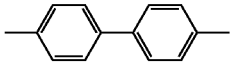 | 0 | — | —H | —H | 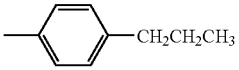 | p-position |
| 28 | 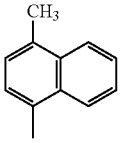 | 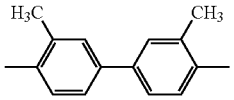 | 0 | — | —H | —H | 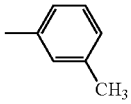 | p-position |
| 29 | 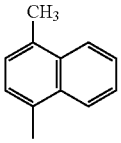 | 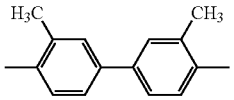 | 0 | — | —H | —H | 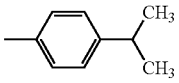 | p-position |
| 30 | 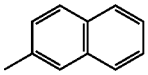 | 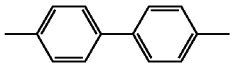 | 0 | — | —H | —H | 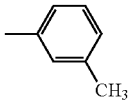 | p-position |
| 31 | 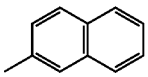 | 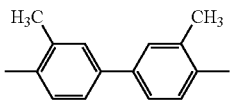 | 0 | — | —H | —H | 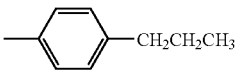 | p-position |
| 32 | 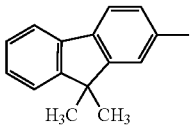 | 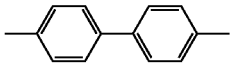 | 0 | — | —H | —H | 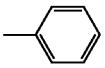 | p-position |
TABLE 5
| Compound | $Ar_1$ | $Ar_2$ | m | $R_1$ | $R_2$ | $R_3$ | $R_4$ | Position of vinyl group |
|---|---|---|---|---|---|---|---|---|
| 33 | 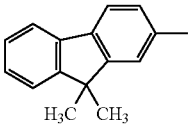 | 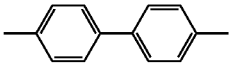 | 0 | — | —H | —H | 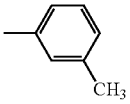 | p-position |

TABLE 5-continued
| Compound | $Ar_1$ | $Ar_2$ | m | $R_1$ | $R_2$ | $R_3$ | $R_4$ | Position of vinyl group |
|---|---|---|---|---|---|---|---|---|
| 34 | 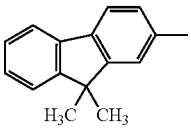 | 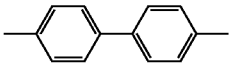 | 0 | — | —H | —H | 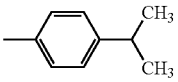 | p-position |
| 35 | 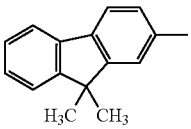 | 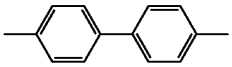 | 0 | — | —H | —H | 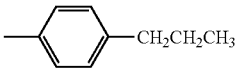 | p-position |
| 36 | 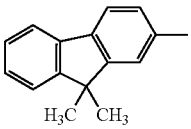 | 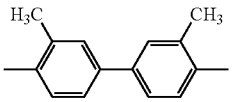 | 0 | — | —H | —H | 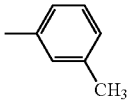 | p-position |
| 37 | 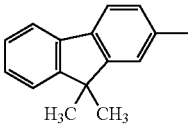 | 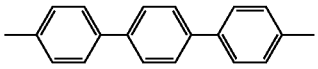 | 0 | — | —H | —H | 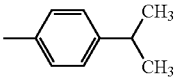 | p-position |
| 38 | 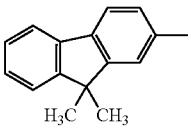 | 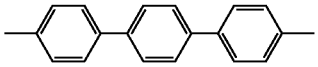 | 0 | — | —H | —H | 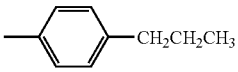 | p-position |
| 39 | 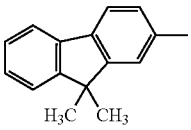 | 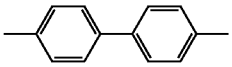 | 0 | — | —H | 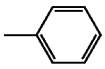 | 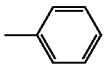 | p-position |
| 40 | 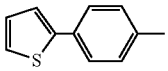 | 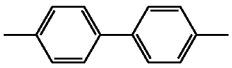 | 0 | — | —H | —H | 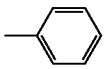 | p-position |
TABLE 6
| Compound | $Ar_1$ | $Ar_2$ | m | $R_1$ | $R_2$ | $R_3$ | $R_4$ | Position of vinyl group |
|---|---|---|---|---|---|---|---|---|
| 41 | 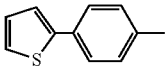 | 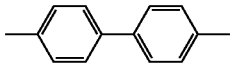 | 0 | — | —H | —H | 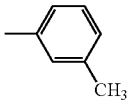 | p-position |
| 42 | 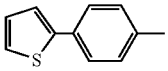 | 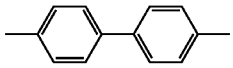 | 0 | — | —H | —H | 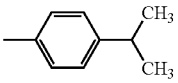 | p-position |
| 43 | 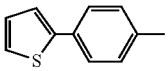 | 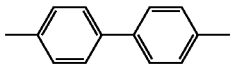 | 0 | — | —H | —H | 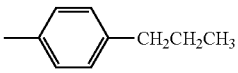 | p-position |

TABLE 6-continued
| Compound | $Ar_1$ | $Ar_2$ | m | $R_1$ | $R_2$ | $R_3$ | $R_4$ | Position of vinyl group |
|---|---|---|---|---|---|---|---|---|
| 44 | 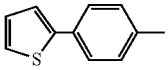 | 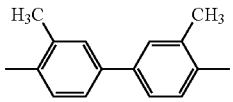 | 0 | — | —H | 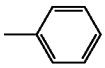 | 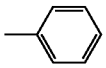 | p-position |
| 45 | 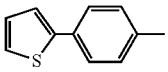 | 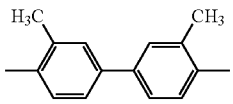 | 0 | — | —H | —H | 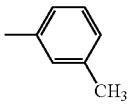 | p-position |
| 46 | 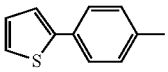 | 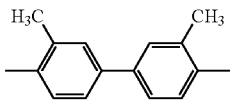 | 0 | — | —H | —H | 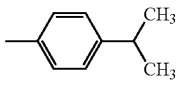 | p-position |
| 47 | 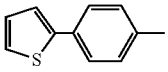 | 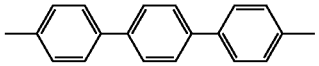 | 0 | — | —$CH_3$ | —H | 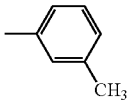 | p-position |
| 48 | 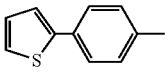 | 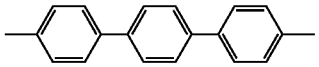 | 0 | — | —$CH_3$ | —H | 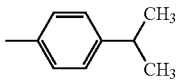 | p-position |
TABLE 7
| Compound | $Ar_1$ | $Ar_2$ | m | $R_1$ | $R_2$ | $R_3$ | $R_4$ | Position of vinyl group |
|---|---|---|---|---|---|---|---|---|
| 49 | 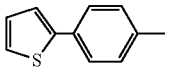 | 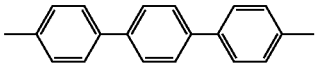 | 0 | — | —H | —H | 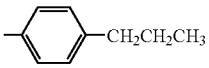 | p-position |
| 50 | 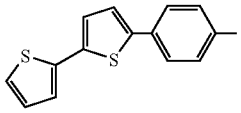 | 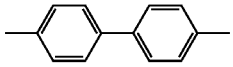 | 0 | — | —H | —H | 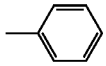 | p-position |
| 51 | 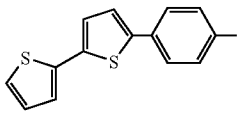 | 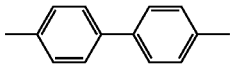 | 0 | — | —H | —H | 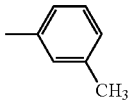 | p-position |
| 52 | 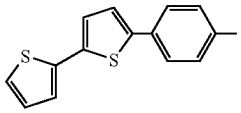 | 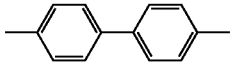 | 0 | — | —H | 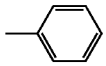 | 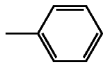 | p-position |
| 53 | 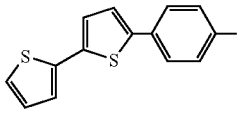 | 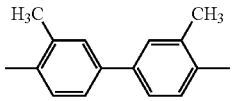 | 0 | — | —H | —H | 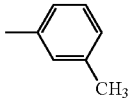 | p-position |
| 54 | 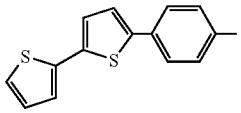 | 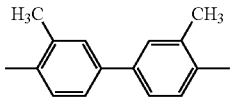 | 0 | — | —H | —H | 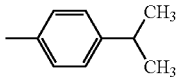 | p-position |

TABLE 7-continued
| Compound | $Ar_1$ | $Ar_2$ | m | $R_1$ | $R_2$ | $R_3$ | $R_4$ | Position of vinyl group |
|---|---|---|---|---|---|---|---|---|
| 55 | 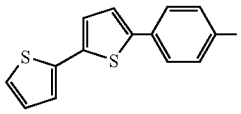 | 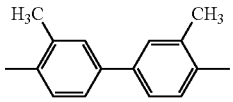 | 0 | — | —H | —H | 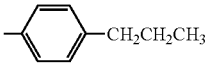 | p-position |
| 56 | 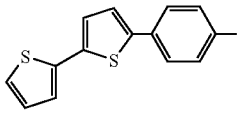 | 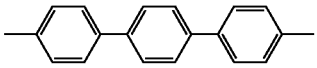 | 0 | — | —H | 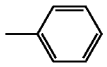 | 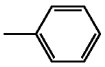 | p-position |
TABLE 8
| Compound | $Ar_1$ | $Ar_2$ | m | $R_1$ | $R_2$ | Ring structure formed with R3 and R4 | Position of vinyl group |
|---|---|---|---|---|---|---|---|
| 57 | 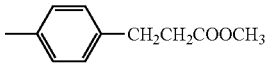 | 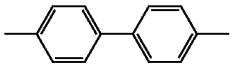 | 0 | — | —H | 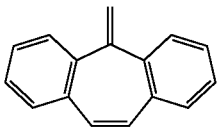 | p-position |
| 58 | 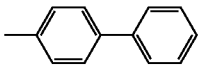 | 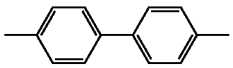 | 0 | — | —H | 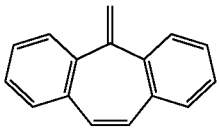 | p-position |
| 59 | 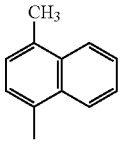 | 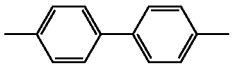 | 0 | — | —H | 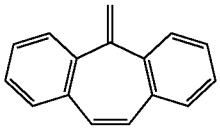 | p-position |
| 60 | 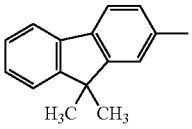 | 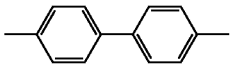 | 0 | — | —H | 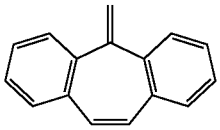 | p-position |
| 61 | 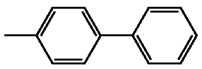 | 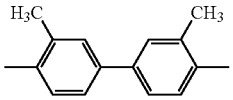 | 0 | — | —H | 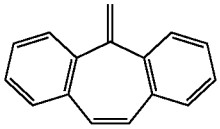 | p-position |
| 62 | 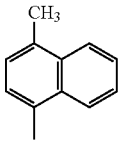 | 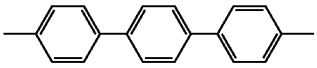 | 0 | — | —H | 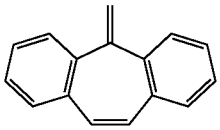 | p-position |
| 63 | 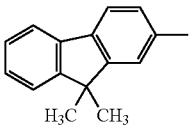 | 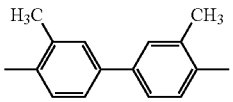 | 0 | — | —H | 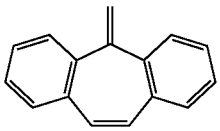 | p-position |

TABLE 8-continued

| Compound | $Ar_1$ | $Ar_2$ | m | $R_1$ | $R_2$ | Ring structure formed with R3 and R4 | Position of vinyl group |
|---|---|---|---|---|---|---|---|
| 64 | 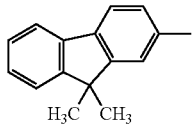 | 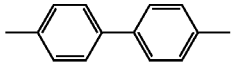 | 0 | — | —H | 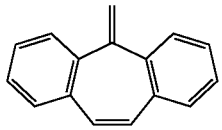 | p-position |

(Production Process of Arylamine Compound)

The arylamine compound represented by formula (I) or (I-1) can be produced by a known process. For example, a known arylamine raw material compound as a raw material is subjected to a known carbonyl introduction reaction (acylation step) and then the Wittig reaction (carbon-carbon double bond introduction step) to obtain the target compound.

The following scheme shows the acylation step where a carbonyl group is introduced into an arylamine raw material compound (I-a) to obtain an acylated arylamine (I-b). The symbols $Ar_1$, $Ar_2$, $R_1$ and m in the arylamine raw material compound (I-a) and the symbols $Ar_1$, $Ar_2$, $R_1$, $R_2$ and m in the acylated arylamine (I-b) have the same meanings as those in formula (I).

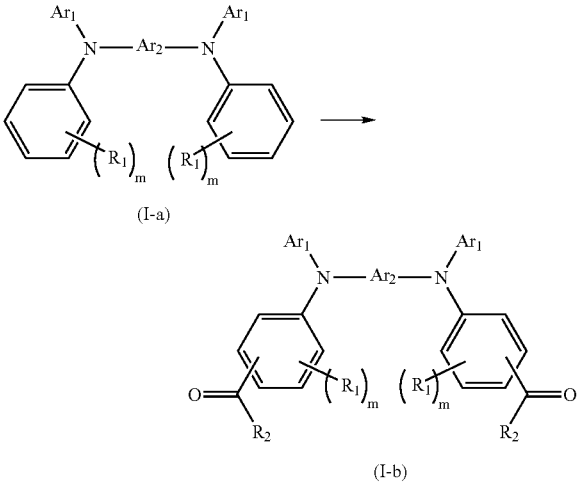

(I-a)

(I-b)

In the acylation step, the reaction conditions are preferably changed as follows depending on the case where the acyl group to be introduced is a formyl group (i.e., $R_2$ represents a hydrogen atom) and the case where the acyl group to be introduced is an acyl group other than a formyl group (i.e., $R_2$ represents a group other than a hydrogen atom).

Case where $R_2$ is Hydrogen Atom:

The arylamine raw material compound (I-a) is reacted with a formylating agent, such as N,N-dimethylformamide and N-methylformanilide, in the presence of phosphorous oxychloride to obtain the acylated arylamine (I-b) (a bis-formyl compound). In this case, the formylating agent may be used excessively to use as a reaction solvent, or a solvent inert to the reaction, such as o-dichlorobenzene, benzene and methylene chloride, may be used. The reaction temperature may be arbitrarily set within a range of from 0° C. to the boiling point of the solvent used, and is preferably from room temperature to 150° C.

Case where $R_2$ is Group other than Hydrogen Atom:

The arylamine raw material compound (I-a) is reacted with an acid chloride represented by formula Cl—CO—R2 in the presence of a Lewis acid, such as aluminum chloride, iron chloride and zinc chloride, in a solvent, such as nitrobenzene, methylene chloride and carbon tetrachloride, to obtain the acylated arylamine (I-b) (a ketone compound) in any case. In this case, the reaction temperature may be arbitrarily set within a range of from 0° C. to the boiling point of the solvent used, and is preferably from room temperature to 150° C.

Thereafter, the carbon-carbon double bond introducing step is carried out, and in this step, the aforementioned aldehyde or ketone compound and the following dialkyl phosphite ester compound (I-c) are subjected to a Wittig-Horner reaction in the presence of a base at a temperature of from room temperature to about 100° C. to obtain the arylamine compound represented by formula (I) as the target compound. The symbols $R_3$ and $R_4$ in the dialkyl phosphite ester compound (I-c) have the same meanings as those in formula (I), and $R_{21}$ therein represents a lower alkyl group, such as a methyl group and an ethyl group.

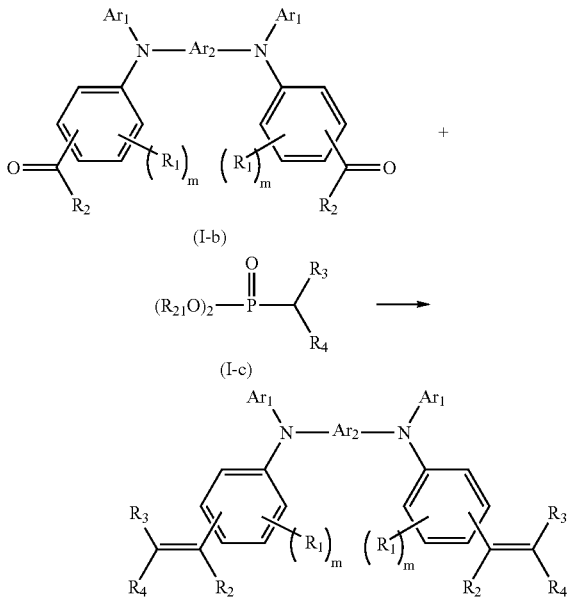

(I-b)

(I-c)

(I)

The base used in the carbon-carbon double bond introducing step include sodium hydroxide, sodium amide and a metallic alkoxide, such as sodium methoxide, sodium tert-butoxide and potassium tert-butoxide. Examples of the solvent include a lower alcohol, such as methanol and ethanol, an ether, such as 1,2-dimethoxyethane, diethyl ether, tetrahydrofuran and dioxane, a hydrocarbon, such as toluene and xylene, a non-protonic polar solvent, such as dimethylsulfoxide, N,N-dimethylformamide, N,N-dimethylacetamide and N-methylpyrrolidone, and mixtures thereof.

After completing the reaction, the arylamine compound represented by formula (I) may be purified by a known method, and for example, adsorption by silica gel, alumina, activated clay or the like may be utilized for the purification. In the case where activated clay is used, the compound is purified preferably by adsorbing in a non-polar solvent, such as toluene, at a temperature of 100° C. or higher to facilitate purification to a high purity compound.

(Electrophotographic Photoreceptor)

Figure 2:
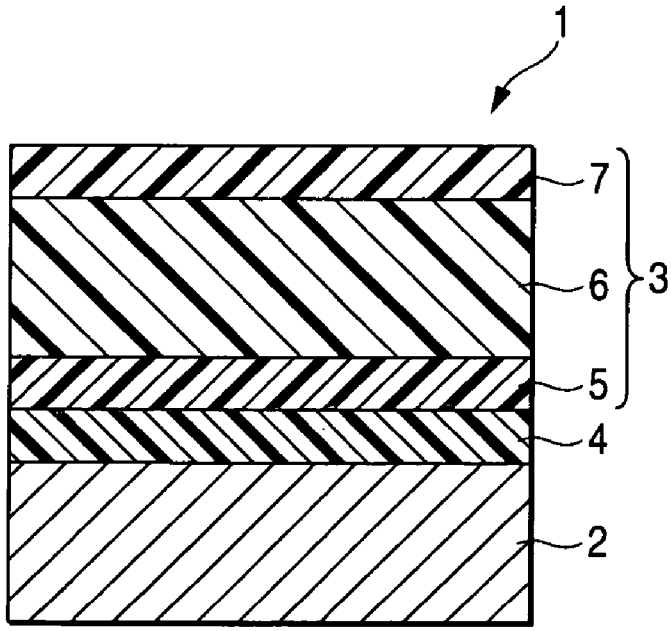
FIG. 2 is a schematic cross sectional view showing an electrophotographic photoreceptor according to a second embodiment of the invention.
Figure 3:
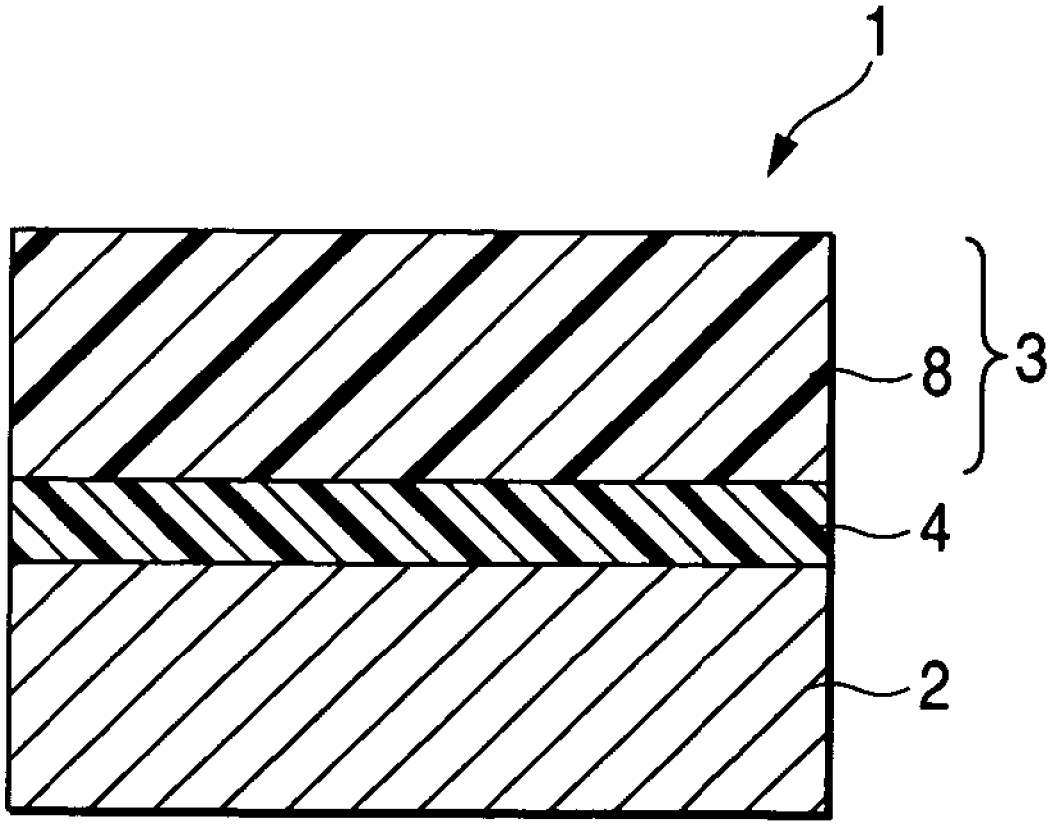
FIG. 3 is a schematic cross sectional view showing an electrophotographic photoreceptor according to a third embodiment of the invention.

FIGS. 1 to 3 are schematic cross sectional views showing electrophotographic photoreceptors according to first to third embodiments of the invention, respectively, on the line cutting the electrophotographic photoreceptor 1 in the accumulation direction of a conductive support 2 and a photosensitive layer 3.

The electrophotographic photoreceptors 1 according to the first and second embodiments shown in FIGS. 1 and 2 have a function-separated photosensitive layer, in which a charge generation material and a charge transport material are contained in different layers. In these embodiments, a layer containing a charge generation material (a charge generation layer 5) and a layer containing a charge transport material (a charge transport layer 6) are separately formed in the photosensitive layer 3 and are accumulated as being adjacent to each other.

The electrophotographic photoreceptor 1 according to the third embodiment shown in FIG. 3 has a single-layer photosensitive layer containing both a charge generation material and a charge transport material in one layer. A charge generation and transport layer 8 containing both a charge generation material and a charge transport material is formed as a single layer in the photosensitive layer 3.

More specifically, the electrophotographic photoreceptor 1 according to the first embodiment is constituted by a conductive support 2 having accumulated thereon an undercoating layer 4, a charge generation layer 5 and a charge transport layer 6 in this order to constitute a photosensitive layer 3. The electrophotographic photoreceptor 1 according to the second embodiment is constituted by a conductive support 2 having accumulated thereon an undercoating layer 4, a charge generation layer 5, a charge transport layer 6 and a protective layer 7 in this order to constitute a photosensitive layer 3. The electrophotographic photoreceptor 1 according to the third embodiment is constituted by a conductive support 2 having accumulated thereon an undercoating layer 4 and a charge generation and transport layer 8 (i.e., a photosensitive layer 3) in this order.

While not shown by figures, an embodiment having the same structure as in the second embodiment except that the charge generation layer 5 and the charge transport layer 6 are inversely accumulated, and an embodiment having the same structure as in the third embodiment except that a protective layer 7 containing the same components as those in the first and second embodiments is provided on the charge generation and transport layer 8, are possible.

Aluminum formed into a suitable shape, such as a dram shape, a sheet shape and a plate shape are used as the conductive support 2, but the invention is not limited thereto. The conductive support 2 may be subjected to an anodic oxidation treatment, a boemite treatment, a honing treatment or the like for such purposes as prevention of charge injection, improvement in adhesiveness, and prevention of interference fringes.

An undercoating layer 4 may be provided between the conductive support 2 and the photosensitive layer 3 or between the conductive support 2 and the charge generation and transport layer 3, as shown in FIGS. 1 to 3. Examples of a material for the undercoating layer 4 include an organic zirconium compound, such as a zirconium chelate compound, a zirconium alkoxide compound and a zirconium coupling agent, an organic titanium compound, such as a titanium chelate compound, a titanium alkoxide compound and a titanate coupling agent, an organic aluminum compound, such as an aluminum chelate compound and an aluminum coupling agent, and an organic metallic compound, such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound and an aluminum zirconium alkoxide compound. Among these, an organic zirconium compound, an organic titanium compound and an organic aluminum compound are preferably used since these compounds have a low residual potential to provide good electrophotographic characteristics.

A silane coupling agent may also be contained in combination, such as vinyltrichlorosilane, vinyltrimethoxysilane, vinyltriethoxysilane, vinyl-tris-2-methoxyethoxysilane, vinyltriacetoxysilane, γ-glycidoxypropylmethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane and β-3,4-epoxycyclohexyltrimethoxysilane.

Furthermore, a known binder resin may also be contained, such as polyvinyl alcohol, polyvinyl methyl ether, poly-N-vinylimidazole, polyethylene oxide, ethylcellulose, methylcellulose, an ethylene-acrylic acid copolymer, polyamide, polyimide, casein, gelatin, polyethylene, polyester, a phenol resin, a vinyl chloride-vinyl acetate copolymer, an epoxy resin, polyvinylpyrrolidone, polyvinylpyridine, polyurethane, polyglutamic acid and polyacrylic acid.

The mixing ratio of the aforementioned components may be arbitrarily determined depending on necessity. The undercoating layer 4 may contain an electron transport pigment mixed or dispersed therein. Examples of the electron transport pigment include an organic pigment, such as a perylene pigment disclosed in JP-A-47-30330, a benzimidazoleperylene pigment, a polycyclic quinone pigment, an indigo pigment and a quinacridone pigment, an organic pigment having an electron attractive substituent, e.g., a cyano group, a nitro group, a nitroso group and a halogen atom, such as a bisazo pigment and a phthalocyanine pigment, and an inorganic pigment, such as zinc oxide and titanium oxide. Among these pigments, a perylene pigment, a benzimidazoleperylene pigment, a polycyclic quinone pigment, zinc oxide and titanium oxide are preferably used owing to the high electron mobility thereof.

The surface of the pigment may be subjected to a surface treatment with the aforementioned coupling agent or binder resin for controlling the dispersibility and the charge transport property. The amount of the electron transport pigment is generally 95% by weight or less, and preferably 90% by weight or less, since the strength of the undercoating layer 4 is deteriorated with a too large amount thereof.

As a method for mixing and dispersing the pigment, an ordinary method using a ball mill, a roll mill, a sand mill, an attritor, ultrasonic wave or the like may be used. The pigment maybe mixed and dispersed in an organic solvent, which may be any one that can dissolve the organic metallic compound and the binder resin and causes no gelation or aggregation upon mixing and dispersing the electron transport pigment. Examples of the organic solvent include an ordinary organic solvent, such as methanol, ethanol, n-propanol, n-butanol, benzyl alcohol, methylcellosolve, ethylcellosolve, acetone, methyl ethyl ketone, cyclohexanone, methyl acetate, b-butyl acetate, dioxane, tetrahydrofuran, methylene chloride, chloroform, chlorobenzene and toluene, which may be used solely or as a mixture of two or more kinds thereof.

The undercoating layer 4 preferably has a thickness of from 0.1 to 30 μm, and more preferably from 0.2 to 25 μm. As a coating method for providing the undercoating layer 4, such a method may be used, as a blade coating method, a Meyer bar coating method, a spray coating method, a dip coating method, a bead coating method, an air knife coating method and a curtain coating method. The coated layer is dried to obtain the undercoating layer 4, and the drying operation is generally carried out at such a temperature that the solvent can be evaporated to form a film. The undercoating layer 4 is preferably formed on a support having been subjected to an acidic solution treatment or a boemite treatment since defects of the support tend to be insufficiently hidden.

Examples of the charge generation material contained in the charge generation layer 5 include a known pigment, such as an azo pigment, such as bisazo and trisazo pigments, a condensed-ring aromatic pigment, such as dibromoanthanthrone, a perylene pigment, a pyrrolopyrrole pigment and a phthalocyanine pigment, and metallic and non-metallic phthalocyanine pigments are preferred. Among these, hydroxygallium phthalocyanine disclosed in JP-A-5-26307 and JP-A-5-279591, chlorogallium phthalocyanine disclosed in JP-A-5-98181, dichlorotin phthalocyanine disclosed in JP-A-5-140472 and JP-A-5-140473, and titanyl phthalocyanine disclosed in JP-A-4-189873 and JP-A-5-43813 are particularly preferred.

The charge generation layer 5 can be formed by mixing the charge generation material and a binder resin, and the binder resin may be selected from a wide range of insulating resins. The binder resin may also be selected from an organic photoconductive polymer, such as poly-N-vinylcarbazole, polyvinylanthracene, polyvinylpyrene and polysilane. Preferred examples of the binder resin include an insulating resin, such as a polyvinyl butyral resin, a polyarylate resin (a polycondensate of bisphenol A and phthalic acid), a polycarbonate resin, a polyester resin, a phenoxy resin, a vinyl chloride-vinyl acetate copolymer, a polyamide resin, an acrylate resin, a polyacrylamide resin, a polyvinylpyridine resin, a cellulose resin, a urethane resin, an epoxy resin, casein, a polyvinyl alcohol resin and a polyvinylpyrrolidone resin, but the invention is not limited thereto. The binder resin may be used solely or as a mixture of two or more kinds thereof.

The mixing ratio (by weight) of the charge generation material and the binder resin is preferably in a range of from 10/1 to 1/10. As a method for dispersing them, an ordinary method may be used, such as a ball mill dispersing method, an attritor dispersing method and a sand mill dispersing method. In the dispersing operation, such conditions are necessary that the crystal form of the charge generation material is not changed by dispersing. It has been confirmed that the crystal form is not changed before and after, the aforementioned dispersing methods carried out in the invention.

It is effective upon dispersing that the charge generation material is dispersed into particles having a diameter of 0.5 μm or less, preferably 0.3 μm or less, and further preferably 0.15 μm or less. Examples of the solvent used upon dispersing include an ordinary organic solvent, such as methanol, ethanol, n-propanol, n-butanol, benzyl alcohol, methylcellosolve, ethylcellosolve, acetone, methyl ethyl ketone, cyclohexanone, methyl acetate, n-butyl acetate, dioxane, tetrahydrofuran, methylene chloride, chloroform, chlorobenzene and toluene, which may be used solely or as a mixture of two or more kinds thereof.

The charge generation layer 5 preferably has a thickness of from 0.1 to 5 μm, and more preferably from 0.2 to 2.0 μm. As a coating method for providing the charge generation layer 5, such an ordinary method may be used, as a blade coating method, a Meyer bar coating method, a spray coating method, a dip coating method, a bead coating method, an air knife coating method and a curtain coating method.

The charge transport layer 6 may be formed by a known technique, and the charge transport layer 6 may be formed by containing a charge transport material and a binder resin or by containing a polymer charge transport material.

The charge transport material may be the compound represented by formula (I) or (I-1) of the invention. The charge transport material may be a mixture of the compound represented by formula (I) or (I-1) of the invention with at least one kind of other charge transport materials, examples of which include an electron transport compound, such as a quinone compound, e.g., p-benzoquinone, chloranil, bromanil and anthraquinone, a tetracyanoquinodimethane compound, a fluorenone compound, e.g., 2,4,7-trinitrofluorenone, a xanthone compound, a benzophenone compound, a cyanovinyl compound and an ethylene compound, and a positive hole transport material, such as a triarylamine compound, a benzidine compound, an arylalkane compound, an aryl-substituted ethylene compound, a stilbene compound, an anthracene compound and a hydrozone compound, but the invention is not limited thereto. In the case where the mixture is used, the charge transport material mixed with the compound represented by formula (I) or (I-1) of the invention is preferably compounds represented by formulae (Ia), (Ib) and (Ic)

(Ia)

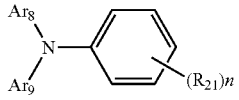

-continued (Ib)

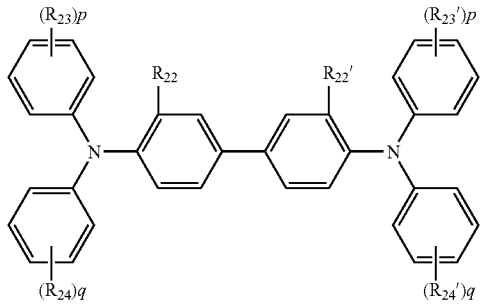

(Ic)

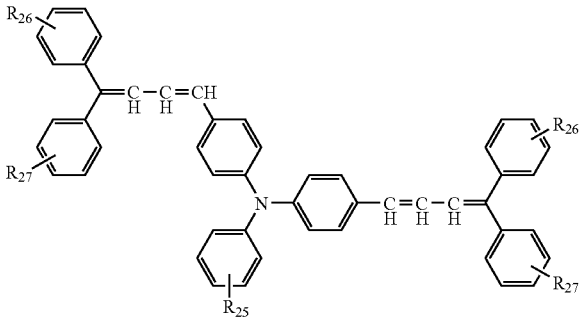

In formula (Ia), $R_{21}$ represents a hydrogen atom or a methyl group, n represents 1 or 2, $Ar_8$ and $Ar_9$ each represents a substituted or unsubstituted aryl group, and examples of the substituent include a halogen atom, an alkyl group having 1 to 5 carbon atoms, an alkoxy group having 1 to 5 carbon atoms and an amino group substituted by an alkyl group having 1 to 3 carbon atoms.

In formula (Ib), $R_{22}$ and $R_{22}'$ may be the same as or different from each other and each represents a hydrogen atom, a halogen atom, an alkyl group having 1 to 5 carbon atoms or an alkoxy group having 1 to 5 carbon atoms, $R_{23}$, $R_{23}'$, $R_{24}$ and $R_{24}'$ may be the same as or different from each other and each represents a hydrogen atom, a halogen atom, an alkyl group having 1 to 5 carbon atoms, an alkoxy group having 1 to 5 carbon atoms, an amino group substituted by an alkyl group having 1 or 2 carbon atoms, or a substituted or unsubstituted aryl group, and p and q each represents an integer of from 0 to 2.

In formula (Ic), $R_{25}$ represents a hydrogen atom, an alkyl group having 1 to 5 carbon atoms, an alkoxy group having 1 to 5 carbon atoms, a substituted or unsubstituted aryl group or —CH═CH—CH═C$(Ar_{10})_2$, $Ar_{10}$ represents a substituted or unsubstituted aryl group, $R_{26}$ and $R_{27}$ may be the same as or different from each other and each represents a hydrogen atom, a halogen atom, an alkyl group having 1 to 5 carbon atoms, an alkoxy group having 1 to 5 carbon atoms, an amino group substituted by an alkyl group having 1 or 2 carbon atoms, or a substituted or unsubstituted aryl group.

Examples of the binder resin used in the charge transport layer 6 include a polycarbonate resin, a polyester resin, a methacrylate resin, an acrylate resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin and a styrene-alkyd resin, and a polymer charge transport material may also be used, such as poly-N-vinylcarbazole, polysilane, and polyester polymer charge transport materials disclosed in JP-A-8-176293 and JP-A-8-208820. The binder resin may be used solely or as a mixture of two or more kinds thereof. The mixing ration (by weight) of the charge transport material and the binder resin is preferably from 10/1 to 1/5.

A polymer charge transport material may be used solely. Known polymers having charge transport property, such as poly-N-vinylcarbazole and polysilane, may be used as the polymer charge transport material. In particular, polyester polymer charge transport materials disclosed in JP-A-8-176293 and JP-A-8-208820 are preferred owing to the high charge transport property thereof. The charge transport layer 6 may be formed with the polymer charge transport material only by itself or may be formed by mixing with the aforementioned binder resin.

The charge transport layer 6 preferably has a thickness of from 5 to 60 μm, and more preferably from 10 to 30 μm. As a coating method for providing the charge transport layer 6, such an ordinary method may be used, as a blade coating method, a wire bar coating method, a spray coating method, a dip coating method, a bead coating method, an air knife coating method and a curtain coating method.

A solvent used upon providing the charge transport layer 6 include an ordinary organic solvent, an aromatic hydrocarbon, such as benzene, toluene, xylene and chlorobenzene, a ketone, such as acetone and 2-butanone, a halogenated aliphatic hydrocarbon, such as methylene chloride, chloroform and ethylene chloride, and a cyclic or linear ether, such as tetrahydrofuran and ethyl ether, which may be used solely or as a mixture of two or more kinds thereof.

The photosensitive layer may be added with an additive, such as an antioxidant, a light stabilizer a thermal stabilizer, for preventing the photoreceptor from being deteriorated due to ozone and an oxidizing gas formed in an image forming apparatus (such as a duplicator) and due to light and heat.

Examples of the antioxidant include hindered phenol, hindered amine, p-phenylenediamine, arylalkane, hydroquinone, spirochroman, spiroindanone, derivatives of these compounds, an organic sulfur compound and an organic phosphorous compound. Examples of the light stabilizer include derivatives of benzophenone, benzotriazole, dithiocarbamate and tetramethylpyridine.

The photosensitive layer may contain at least one kind of an electron accepting substance for improving the sensitivity, reducing the residual potential and relieving fatigue upon repeated use. Examples of the electron accepting substance that can be used herein include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid and phthalic acid. Among these, a fluorenone compound, a quinone compound and a benzene derivative having an electron attracting substituent, such as —Cl, —CN and —$NO_2$, are particularly preferred.

The electrophotographic photoreceptor of the invention may have a protective layer 7 (surface layer) as having been described, and the protective layer 7 is preferably a high strength protective layer (high strength surface layer) for imparting resistance to abrasion and damages. The high strength protective layer include a layer containing a binder resin having conductive fine particles dispersed therein, a layer containing an ordinary charge transport layer material having lubricating fine particles, such as a fluorine resin and an acrylate resin, dispersed therein, and a hard coating agent, such as silicone and acrylate. A layer containing a siloxane resin having charge transport property and a crosslinked structure is preferred from the standpoint of strength, electric characteristics and maintenance property of image quality, and a layer having a structure represented by formula (II) is preferred since it is excellent in strength and stability.

G-D-F (II)

In formula (II), G represents an inorganic vitric network subunit, D represents a flexible organic subunit, and F represents a charge transport subunit. The charge transport subunit F include a structure having light carrier transport property, such as a triarylamine compound, a benzidine compound, an arylalkane compound, an aryl-substituted ethylene compound, a stilbene compound, an anthracene compound, a hydrazone compound, a quinone compound, a fluorenone compound, a xanthone compound, a benzophenone compound, a cyanovinyl compound and an ethylene compound.

The inorganic vitric network subunit G in formula (II) is preferably a Si group having reactivity, which forms an inorganic vitric network having a three-dimensional Si—O—Si bond through mutual crosslinking reaction.

The flexible organic subunit D in formula (II) is for binding the charge transport subunit F for imparting charge transport property directly to the three-dimensional vitric network. The flexible organic subunit D also imparts moderate flexibility to the inorganic vitric network, which has brittleness along with toughness.

D has such a group that binds the compounds represented by formula (II) via a bond, which means a group capable of bonding to a silanol group formed upon hydrolysis of the compound represented by formula (II), and examples of the group include a group represented by $—Si(R_8)_{(3-a)}Q_a$, an epoxy group, an isocyanate group, a carboxyl group, a hydroxyl group and a halogen atom. Among these, a compound having a group represented by $—Si(R_8)_{(3-a)}Q_a$, an epoxy group or an isocyanate group is preferred since it provides high mechanical strength. Here, $R_8$ represents a hydrogen atom, an alkyl group or a substituted or unsubstituted aryl group, Q represents a hydrolysable group. A compound having two or more of the groups in one molecule is preferred since it provides a cured film having a three-dimensional structure to exert higher mechanical strength.

The compound represented by formula (II) preferably has a structure represented by formula (III) since the compound is excellent in charge transport property, light resistance and resistance to gases formed by electric discharge.

In formula (III), $Ar_3$, $Ar_4$, $Ar_5$ and $Ar_6$ each independently represents a substituted or unsubstituted aryl group, $Ar_7$ represents a substituted or unsubstituted aryl group or a substituted or unsubstituted arylene group, and 1 to 4 of $Ar_3$, $Ar_4$, $Ar_5$ and $Ar_6$ have a bond capable of binding with a structure represented by -D-G and the bond is bound to a subunit D, D represents a flexible organic subunit (such as a divalent aliphatic group), G is derived from a substituted silicone group having a hydrolyzable group represented by $—Si(R_8)_{(3-a)}Q_a$, $R_8$ represents a hydrogen atom, an alkyl group or a substituted or unsubstituted aryl group, Q represents a hydrolyzable group, a represents an integer of from 1 to 3, b represents an integer of from 1 to 4, and k represents an integer of 0 or 1.

(III)

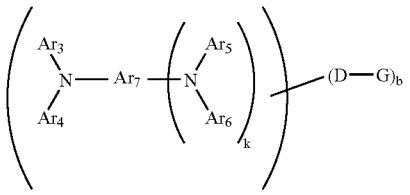

The compound represented by formula (II) is more preferably a compound represented by formula (IIIa) from the standpoint of charge transport property, light resistance and resistance to gases formed by electric discharge.

In formula (IIIa), $Ar_3'$, $Ar_4'$ $Ar_5'$ and $Ar_6'$ each independently represents a substituted or unsubstituted arylene group (preferably a substituted or unsubstituted phenylene group), and $Ar_7$ has the same meaning as in formula (III) (preferably a divalent group derived from a substituted or unsubstituted biphenyl). Z represents a hydrogen atom or a group represented by -D'-G', provided that at least one group represented by Z is a group represented by -D'-G', wherein D' represents a divalent aliphatic group (which may have an ester group, an ether group, a thioether group or the like, and preferably has 1 to 12 carbon atoms), and G' represents a group represented by $—Si(R_8)_{(3-a)}Q_a$. $R_8$, k and a have the same meaning as in formula (III), and Q represents a hydrolyzable group selected from a halogen atom, an alkoxy group (preferably an alkoxy group having 1 to 3 carbon atoms), an acyloxy group, an alketyloxy group, an aminogroup, a mercapto group, a ketoximate group, an aminooxy group and a carbamoyl group.

(IIIa)

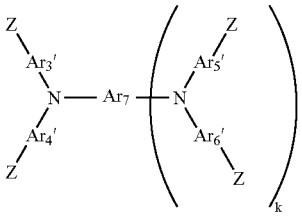

In the protective layer 7, another coupling agent and a fluorine compound may be used in combination for such purposes as adjustment of the film forming property and the flexibility of the layer. Various kinds of silane coupling agents and commercially available silicone hard coating agents can be used as these compounds.

Examples of the silane coupling agent include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldiethoxysilane, N-β-(aminoethyl)-γ-aminopropyltriethoxysilane, tetremethoxysilane, methyltrimethoxysilane and dimethyldimethoxysilane. Examples of the commercially available hard coating agent include KP-85, X-40-9740 and X-40-2239 (produced by Shin-Etsu Silicone Co., Ltd.), and AY42-440, AY42-441 and AY49-208 (produced by Toray Dow Corning Co., Ltd.).

The protective layer 7 may contain a fluorine-containing compound for imparting water repelling property and low stickiness property, example of which include (tridecafluoro-1,1,2,2-tetrahydrooctyl)triethoxysila ne, (3,3,3-trifluoropropyl)trimethoxysilane, 3-(heptafluoroisopropoxy) propyltriethoxysilane, 1H,1H,2H,2H-perfluoroalkyltriethoxysilane, 1H,1H,2H,2H-perfluorodecyltriethoxysilane and 1H,1H,2H,2H-perfluorooctyltriethoxysilane. The silane coupling agent may be used in an arbitrary amount, the amount of the fluorine-containing compound is preferably 0.25 or less by weight based on the compound containing no fluorine. In the case where the amount exceeds the value, there are some cases where a problem occurs in film forming property of the crosslinked film. In order to improve the strength of the film, it is preferred to use simultaneously a compound having two or more substituted silicone groups each having a hydrolyzable group represented by $—Si(R_8)_{(3-a)}Q_a$.

The coating composition may be prepared without a solvent or by using a solvent depending on necessity, for example, an alcohol, such as methanol, ethanol, propanol and butanol, a ketone, such as acetone and methyl ethyl ketone, and an ether, such as tetrahydrofuran, diethyl ether and dioxane, with a solvent having a boiling point of 100° C. or less being preferred. The solvent may be used solely or after arbitrarily mixing. The amount of the solvent may be arbitrarily determined, but since a too small amount of the solvent makes the compound represented by formula (II) tend to be deposited, the solvent is generally used in an amount of from 0.5 to 30 parts, and preferably from 1 to 20 parts, per 1 part of the compound represented by formula (II). The reaction temperature and the reaction time vary depending on the kinds of the raw materials, and the temperature is generally from 0 to 100° C., preferably from 10 to 70° C., and particularly preferably from 15 to 50° C. The reaction time is not particularly limited and is preferably from 10 minutes to 100 hours since a too long reaction time tends to cause gelation.

A curing catalyst used herein include a protonic acid, such as hydrochloric acid, acetic acid, phosphoric acid and sulfuric acid, a base, such as ammonia and triethylamine, an organic tin compound, such as dibutyltin diacetate, dibutyltin dioctoate and stannous octoate, an organic titanium compound, such as tetra-n-butyl titanate and tetraisopropyl titanate, an organic aluminum compound, such as aluminum tributoxide and aluminum triacetylacetonate, and an iron salt, a manganese salt, a cobalt salt, a zinc salt and zirconium salt of an organic carboxylic acid. A metallic compound is preferred from the standpoint of storage stability, and a metallic acetylacetonate and a metallic acetylacetate are further preferred, with aluminum triacetylacetonate being particularly preferred.

The using amount of the curing catalyst may be arbitrarily determined and is preferably from 0.1 to 20% by weight, and more preferably from 0.3 to 10% by weight, based on the material containing a hydrolyzable silicone substituent, from the standpoint of storage stability, characteristics and strength. The curing temperature may be arbitrarily determined and is preferably 60° C. or more, and more preferably 80° C. or more, for obtaining desired strength. The curing time may be arbitrarily determined depending on necessity and is preferably from 10 minutes to 5 hours. It is also effective that after completing the curing reaction, the cured layer is maintained at a high humidity state to stabilize the characteristics. Moreover, the layer may be subjected to a surface treatment by using hexamethylsilazane or trimethylchlorosilane to obtain a hydrophobic surface.

The protective layer 7 of the electrophotographic photoreceptor preferably contains an antioxidant for preventing deterioration due to an oxidizing gas, such as ozone, generated in a charging device. In the case where the photoreceptor has a long service life by improving the mechanical strength of the surface of the photoreceptor, the photoreceptor is exposed to an oxidizing gas for a long period of time, and therefore, higher oxidation resistance than the conventional products is demanded.

Preferred examples of the antioxidant include a hindered phenol antioxidant and a hindered amine antioxidant, and other known antioxidants may be used, such as an organic sulfur antioxidant, a phosphite antioxidant, a dithiocarbamate salt antioxidant, a thiourea antioxidant and a benzimidazole antioxidant. The addition amount of the antioxidant is preferably 20% by weight or less, and more preferably 10% by weight or less.

Examples of the hindered phenol antioxidant include 2,6-di-t-butyl-4-methylphenol, 2,5-di-t-butylhydroquinone, N,N'-hexamethylenebis(3,5-t-butyl-4-hydroxy)hydrocin namide, 3,5-di-t-butyl-4-hydroxybenzylphosphonate diethyl ester, 2,4-bis((octylthio)methyl)-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-met hylphenyl acrylate and 4,4'-butylidenebis(3-methyl-6-t-butylphenol).

A resin soluble in an alcohol may be added for such purposes as resistance to an electric discharge gas, mechanical strength, flaw resistance, dispersibility of particles, control of the viscosity, reduction in torque, control of the abrasion amount, and prolongation of the pot life. Examples of the resin soluble in an alcohol include a polyvinyl butyral resin, polyvinyl formal resin, a polyvinyl acetal resin, such as a partially acetalated polyvinyl acetal resin, in which a part of butyral is modified with formal or aectoacetal (such as S-Lec B and K, produced by Sekisui Chemical Co., Ltd.), a polyamide resin, a cellulose resin and a phenol resin. In particular, a polyvinyl acetal resin is preferred from the standpoint of electric characteristics. The resin preferably has a molecular weight of from 2,000 to 100,000, and more preferably from 5,000 to 50,000. In the case where the molecular weight is less than 2,000, the intended effect cannot be obtained, and in the case where it exceeds 100,000, the addition amount is restricted due to the low solubility, and film formation failure occurs upon coating. The addition amount of the resin is preferably from 1 to 40%, more preferably from 1 to 30%, and most preferably from 5 to 20%. In the case where the addition amount is less than 1%, the intended effect is difficult to obtain, and in the case where it exceeds 40%, image blur is liable to occur under high temperature and high humidity conditions.

Various kinds of fine particles may be added to the protective layer 7 for improving the resistance to attachment of contaminants and the lubricating property of the surface of the electrophotographic photoreceptor. The fine particles may be used solely or as a mixture of two or more kinds thereof. Examples of the fine particles include silicon-containing fine particles. The silicon-containing fine particles are fine particles containing silicon as a constitutional element, specific examples of which include colloidal silica and silicone fine particles. The colloidal silica used as the silicon-containing fine particles generally has an average particle diameter of from 1 to 100 nm, and preferably from 10 to 30 nm, in the form of an alkaline aqueous dispersion liquid or a dispersion liquid in an organic solvent, such as an alcohol, a ketone and an ester, and commercially available products thereof may be used herein. The solid content of the colloidal silica in the outermost layer is not particularly limited and is generally from 0.1 to 50% by weight, and preferably from 0.1 to 30% by weight, based on the total solid content of the outermost layer, from the standpoint of film forming property, electric characteristics and strength.

The silicone fine particles used as the silicon-containing fine particles generally has a spherical shape and an average particle diameter of from 1 to 500 nm, and preferably from 10 to 100 nm, and selected from silicone resin particles, silicone rubber particles and silica particles having been subjected to silicone surface treatment. Commercially available products thereof may be used herein. The silicone fine particles are particles having a small diameter that are chemically inert and excellent in dispersibility in a resin. The content of the silicone fine particles that is required for attaining the sufficient characteristics is small, and therefore, the surface property of the electrophotographic photoreceptor can be improved thereby without impair of the crosslinking reaction.

That is, the silicone fine particles are uniformly incorporated in the firm crosslinked structure to improve the lubricating property and the water repelling property of the surface of the electrophotographic photoreceptor, whereby the wear resistance and the resistance to attachment of contaminants can be maintained in good conditions for a long period of time. The content of the silicone fine particles in the outermost layer of the electrophotographic photoreceptor is preferably from 0.1 to 30% by weight, and more preferably from 0.5 to 10% by weight, based on the total solid content in the outermost layer.

Other examples of the fine particles include fluorine fine particles, such as fluorine resins of tetrafluoroethylene, trifluoroethylene, hexafluoropropylene, vinyl fluoride and vinylidene fluoride, fine particles of a resin formed by copolymerizing the aforementioned fluorine resin and a monomer having a hydroxyl group, as described in *Preprints of 8th Polymer Materials Forum, Japan,* p. 89, and fine particles of semiconductive metallic oxide, such as ZnO—$Al_2O_3$, $SnO_2$—$Sb_2O_3$, $In_2O_3$—$SnO_2$, ZnO—$TiO_2$, ZnO—$TiO_2$, MgO—$Al_2O_3$, FeO—$TiO_2$, $TiO_2$, $SnO_2$, $In_2O_3$, ZnO and MgO.

An oil, such as a silicone oil, may also be added to the protective layer 7 for the similar purposes. Examples of the silicone oil include a silicone oil, such as dimethypolysiloxane, diphenylpolysiloxane and phenylmethylpolysiloxane, a reactive silicone oil, such as amino-modified polysiloxane, epoxy-modified polysiloxane, carboxyl-modified polysiloxane, carbinol-modified polysiloxane, methacryl-modified polysiloxane, mercapto-modified polysiloxane and phenol-modified polysiloxane, and a cyclic siloxane, for example, a cyclic dimethylcyclosiloxane, such as hexamethylcyclotrisiloxane, octamethylcyclotetrasiloxane, decamethylcyclopentasiloxane and dodecamethylcyclohexasiloxane, a cyclic methylphenylcyclosiloxane, such as 1,3,5-trimethyl-1,3,5-triphenylcyclotrisiloxane, 1,3,5,7-tetramethyl-1,3,5,7-tetraphenylcyclotetrasil oxane and 1,3,5,7,9-pentamethyl-1,3,5,7,9-pentaphenylcyclopent a siloxane, a cyclic phenylcyclosiloxane, such as hexaphenylcyclotrisiloxane, a fluorine-containing cyclosiloxane, such as 3-(3,3,3-trifluoropropyl)methylcyclotrisiloxane, a methylhydrosiloxane mixture, pentamethylcyclopentasiloxane, a hydrosilyl group-containing cyclosiloxane, such as phenylhydrocyclosiloxane, and a vinyl group-containing cyclosiloxane, such as pentavinylpentamethylcyclopentasiloxane.

In the case of a single-layer photosensitive layer, the single-layer photosensitive layer may be formed by containing the charge generation material, the charge transport material including the arylamine compound of the invention, and a binder resin. The charge transport material may be a polymer charge transport material. The binder resin may be the same as those used in the charge generation layer 5 and the charge transport layer 6. The content of the charge generation material in the single-layer photosensitive layer is generally from 10 to 85% by weight, and preferably from 20 to 50% by weight. The content of the charge transport material is preferably from 5 to 50% by weight. The compound represented by formula (II) may be added. The solvent used for coating and the coating method may be the same as those described in the foregoing. The single-layer photosensitive layer preferably has a thickness of from 5 to 50 μm, and more preferably from 10 to 40 μm.

The outermost layer of the electrophotographic photoreceptor that is disposed at the farthest position from the conductive support may be coated with or dipped in an aqueous dispersion liquid of a modifying resin containing a fluorine resin as an essential component, which is preferred since the transfer efficiency can be improved. It is also possible that wear of the photosensitive layer through the repeated process including charge, exposure, development, transfer and cleaning can be sufficiently suppressed from proceeding, so as to attain a prolonged service life of the photoreceptor.

The aqueous dispersion liquid of a modifying resin containing a fluorine resin as an essential component, which is to be applied to the outermost layer of the electrophotographic photoreceptor, will be described. Examples of the fluorine resin include a homopolymer of tetrafluoroethylene, a copolymer of tetrafluoroethylene with an olefin, a fluorine-containing olefin, a perfluoroolefin or a fluoroalkyl vinyl ether, a homopolymer of vinylidene fluoride, a copolymer of vinylidene fluoride with an olefin, a fluorine-containing olefin, a perfluoroolefin or a fluoroalkyl vinyl ether, a homopolymer of chlorotrifluoroethylene, and a copolymer of chlorotrifluoroethylene with an olefin, a fluorine-containing olefin, a perfluoroolefin or a fluoroalkyl vinyl ether, and a homopolymer or a copolymer of tetrafluoroethylene are particularly preferred. It is also preferred that a homopolymer of tetrafluoroethylene and various kinds of copolymers are used as a mixture in a weight ratio of from 95/5 to 10/90.

The modifying resin containing a fluorine resin as an essential component is used as an aqueous dispersion liquid, and the aqueous dispersion liquid may further contain wax and/or silicone. It is preferred that the aqueous dispersion liquid contains wax and/or silicone for accelerating infiltration of the fluorine resin into the interior of a blade.

Examples of the wax include paraffin wax, microcrystalline wax and petrolatum, and examples of the silicone include a silicone oil, silicone grease, a silicone oil compound and silicone varnish.

The aqueous dispersion liquid of the modifying resin containing a fluorine resin as an essential component may further contain, depending on necessity, a nonionic, cationic, anionic or amphoteric surfactant, a pH adjusting agent, a solvent, a polyhydric alcohol, a softening agent, a viscosity adjusting agent, a light stabilizer and an antioxidant. An infiltration layer may be formed by dipping a blade member into the aqueous dispersion liquid of the modifying resin containing a fluorine resin as an essential component. The infiltration layer may be formed under reduced pressure for accelerating infiltration of the fluorine resin into the interior of the blade member. The pressure in this case is generally 0.9 atm or less, preferably 0.8 atm or less, and more preferably 0.7 atm or less.

It is also effective for accelerating the infiltration that the aqueous dispersion liquid is heated to 40° C. or more, and preferably 50° C. or more. Furthermore, it is effective that the formation of the infiltration layer is carried out at 0.1 atm or more, preferably 0.2 atm or more, and more preferably 0.3 atm or more, and combinations of the reduced pressure, the increased pressure and the heat treatment are also effective. The aqueous dispersion liquid may be attached to the blade member by spraying or coating, followed by heating to 40° C. or more, preferably 50° C. or more, so as to form the infiltration layer. Moreover, after attaching the aqueous dispersion liquid of the modifying resin containing a fluorine resin as an essential component, wiping or washing may be carried out before or after the heat drying.

(Image Forming Apparatus)

Figure 4:
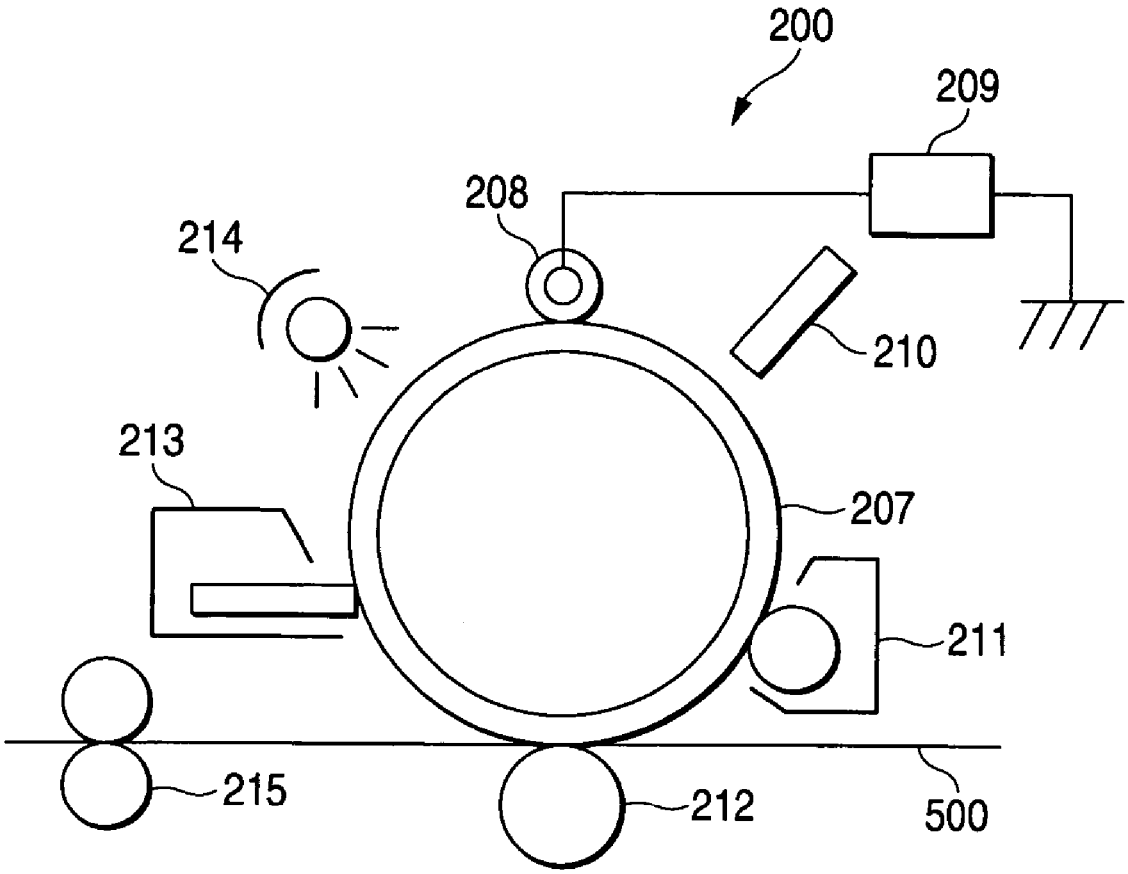
FIG. 4 is a schematic constitutional view showing an image forming apparatus according to an embodiment of the invention.

FIG. 4 is a schematic constitutional view showing an image forming apparatus according to a preferred embodiment of the invention. The image forming apparatus 200 shown in FIG. 4 has an electrophotographic photoreceptor 207 according to the invention, a charging unit 208 for charging the electrophotographic photoreceptor 207, an electric power source 209 connected to the charging unit 208, an exposure unit 210 for exposing the electrophotographic photoreceptor 207 which has been charged by the charging unit 208 to form an electronic latent image, a developing unit 211 for developing the electronic latent image which has been formed by the exposure unit 210 with a toner to form a toner image, a transferring unit 212 for transferring the toner image, which has been formed by the developing unit 211, to a recording medium 500, a cleaning unit 213, a destaticizing unit 214, and a fixing unit 215.

The charging unit 208 shown in FIG. 4 charges the surface of the photo receptor 207 to a prescribed potential by making a contact type charging member (for example, a charging roll) into contact with the surface of the photoreceptor 207 to apply a voltage uniformly to the photoreceptor.

As the contact type charging member, such a member having a roller form can be preferably used that has a core material having provided on an outer periphery thereof an elastic layer, a resistor layer, a protective layer and the like. The shape of the contact type charging member may be either a brush form, a blade form, a pin electrode form or the like, in addition to the aforementioned roller form, and can be arbitrarily selected depending on the specification and the form of the image forming apparatus.

The material for the core material of the contact type charging member having a roller form may be a conductive material, such as iron, copper, brass, stainless steel, aluminum and nickel. A resin molded material having conductive particles dispersed therein may also be used as the core material. The material for the elastic layer may be a material exhibiting conductivity or semiconductivity, such as a rubber material having conductive particles or semiconductive particles dispersed therein. The materials for the resistor layer and the protective layer may be a binder resin having been controlled in resistance thereof by dispersing conductive particles or semiconductive particles therein.

A voltage is applied to the contact type charging member upon charging the photoreceptor by using the contact type charging member, and the voltage thus applied maybe a direct current voltage or a direct current voltage having an alternate current voltage overlapped thereon.

A non-contact type charging member, such as a corotron and a scorotron, maybe used instead of the contact type charging member shown in FIG. 4. The charging member maybe arbitrarily selected depending on the specification and the form of the image forming apparatus.

The exposure unit 210 include an optical system device capable of imagewise exposing the surface of the electrophotographic photoreceptor by using a light source, such as a semiconductor laser, an LED (light emitting diode) and a liquid crystal shutter.

The developing unit 211 may be a known developing device having been known in the art using a one-component or two-component positive or negative developer. The shape of the toner used in the developing unit 211 is not particularly limited, and a spherical toner is preferred from the standpoint of high image quality and environmental protection.

The transferring unit 212 include a contact type charging member having a roller form, and also include a contact type transfer charging device using a belt, a film, a rubber blade or the like, and a scorotron transfer charging device or a corotron transfer charging device utilizing corona discharge.

The cleaning unit 213 is provided for removing the remaining toner attached to the surface of the electrophotographic photoreceptor after the transferring step. The electrophotographic photoreceptor having a surface thus cleaned by the cleaning unit is then repeatedly subjected to the aforementioned image forming process. The cleaning unit include a cleaning blade, and also include a cleaning brush and a cleaning roll, and among these, a cleaning blade is preferably used. A material for the cleaning blade include urethane rubber, neoprene rubber and silicone rubber.

The aforementioned embodiment of the image forming apparatus has only one image forming unit, and an image forming apparatus according to another embodiment may be a tandem type image forming apparatus having plural image forming units.

For example, in the case where four image forming units are contained, color toners of four colors, i.e., yellow, magenta, cyan and black, may be used in the four developing units of the image forming units, respectively. The tandem type image forming apparatus preferably contains a belt for conveying a recording medium commonly to the four image forming units, a conveying unit for conveying the belt, a toner feeding unit for feeding toners to the developing units, respectively, and a fixing unit for fixing a color toner image to the recording medium. In alternative, the tandem type image forming apparatus preferably contains an intermediate transfer material applied commonly to the four image forming units, a conveying unit for conveying the intermediate transfer material, a toner feeding unit for feeding toners to the developing units, respectively, a primary transfer unit for sequentially transferring images formed in the respective image forming units to the intermediate transfer material, a secondary transfer unit for transferring the color toner images on the intermediate transfer material to a recording medium at a time, a fixing unit for fixing the color toner images thus transferred to the recording medium.

The image forming apparatus according to the invention having been described exerts excellent durability particularly in the case where an electrophotographic photoreceptor having a high mechanical strength is used, and the case where a contact charging system applying large stress to the electrophotographic photoreceptor is used. The image forming apparatus according to the invention preferably contains such a system that is capable of feeding only a toner solely in the case where the electrophotographic photoreceptor thereof can be used by 200,000 cycles or more, preferably 250,000 cycles or more, and more preferably 300,000 cycles or more.

The effect of the image forming apparatus according to the invention is significantly exerted in the case where the electrophotographic process speed is 300 mm/sec or more, and preferably 400 mm/sec or more, owing to the high sensitivity and the fast responsiveness of the electrophotographic photoreceptor of the invention.

(Process Cartridge)

Figure 5:
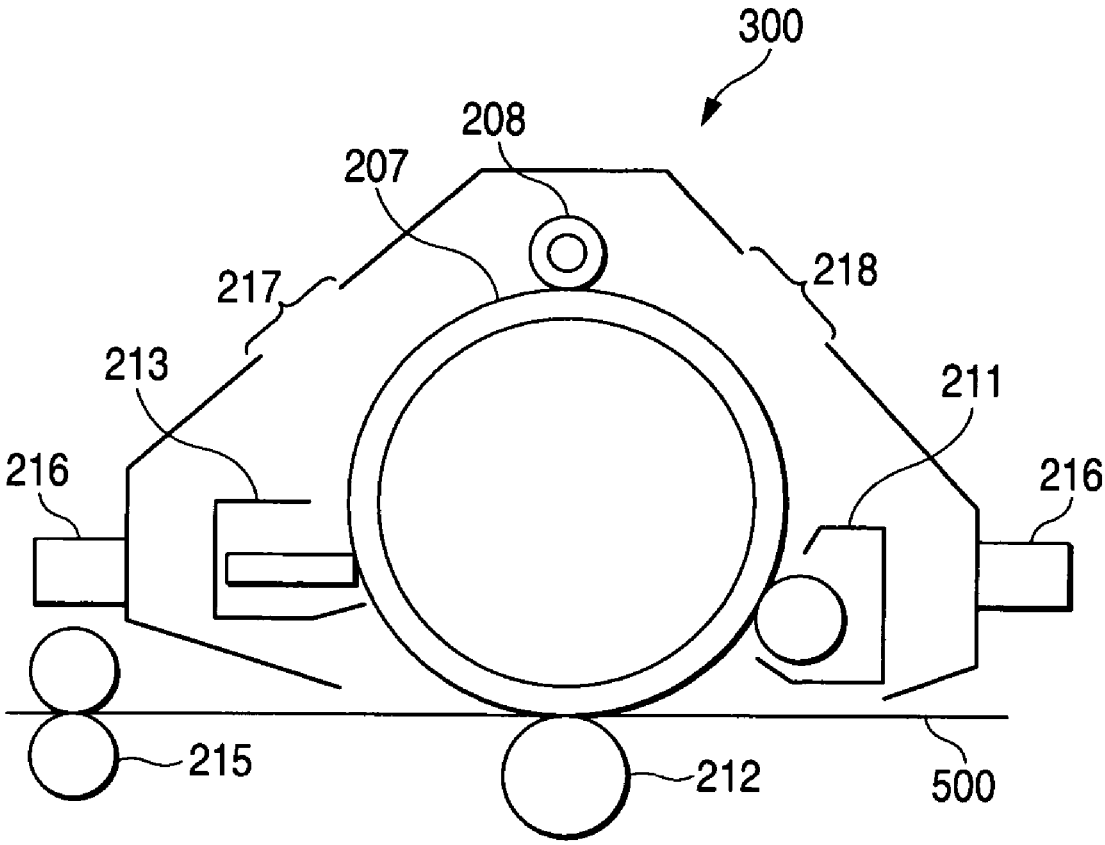
FIG. 5 is a schematic constitutional view showing a process cartridge according to an embodiment of the invention.

FIG. 5 is a schematic constitutional view showing a process cartridge according to a preferred embodiment of the invention. The process cartridge 300 has an electrophotographic photoreceptor 207, along with a charging unit 208, a developing unit 211, a cleaning unit 213, an opening 218 for exposure, and an opening 217 for destaticizing exposure, which are combined by using an assembly rail 216 for integration.

The process cartridge 300 can be freely detachable to an image forming apparatus main body containing a transferring unit 212 for transferring a toner image formed by the developing unit 211 to a recording medium 500, a fixing unit 215 and other constitutional components not shown in the figure, and the process cartridge 300 constitutes an image forming apparatus associated with the image forming apparatus main body.

While the invention has been described with reference to the aforementioned preferred embodiments, various changes and modifications can be made in the invention within the scope of the gist of the invention.

EXAMPLE

The invention will be described with reference to the following examples and comparative examples, but the invention is not construed as being limited thereto.

Example 1

Synthesis of Compound 10

50 parts by weight of the following tetraarylbenzidine compound (A) is suspended in 600 parts by weight of N,N'-dimethylformamide (DMF), to which 48 parts by weight of phosphorous oxychloride is added dropwise at room temperature over 1 hour. Thereafter, the mixture is heated and stirred at 90° C. for 24 hours. The reaction product is slowly poured into 4 L of water, and after heating and stirring at 50° C. for 2 hours, the reaction product is extracted with 2 L of toluene at room temperature. The toluene solution is washed with water and dried over sodium sulfate. After filtering out sodium sulfate, 200 parts by weight of activated clay is added to the toluene solution, which is then refluxed for 1 hour, followed by filtering out activated clay. The resulting toluene solution is concentrated and then recrystallized twice from toluene to obtain 36 parts by weight of a target bisformylated compound (B).

Figure 6:
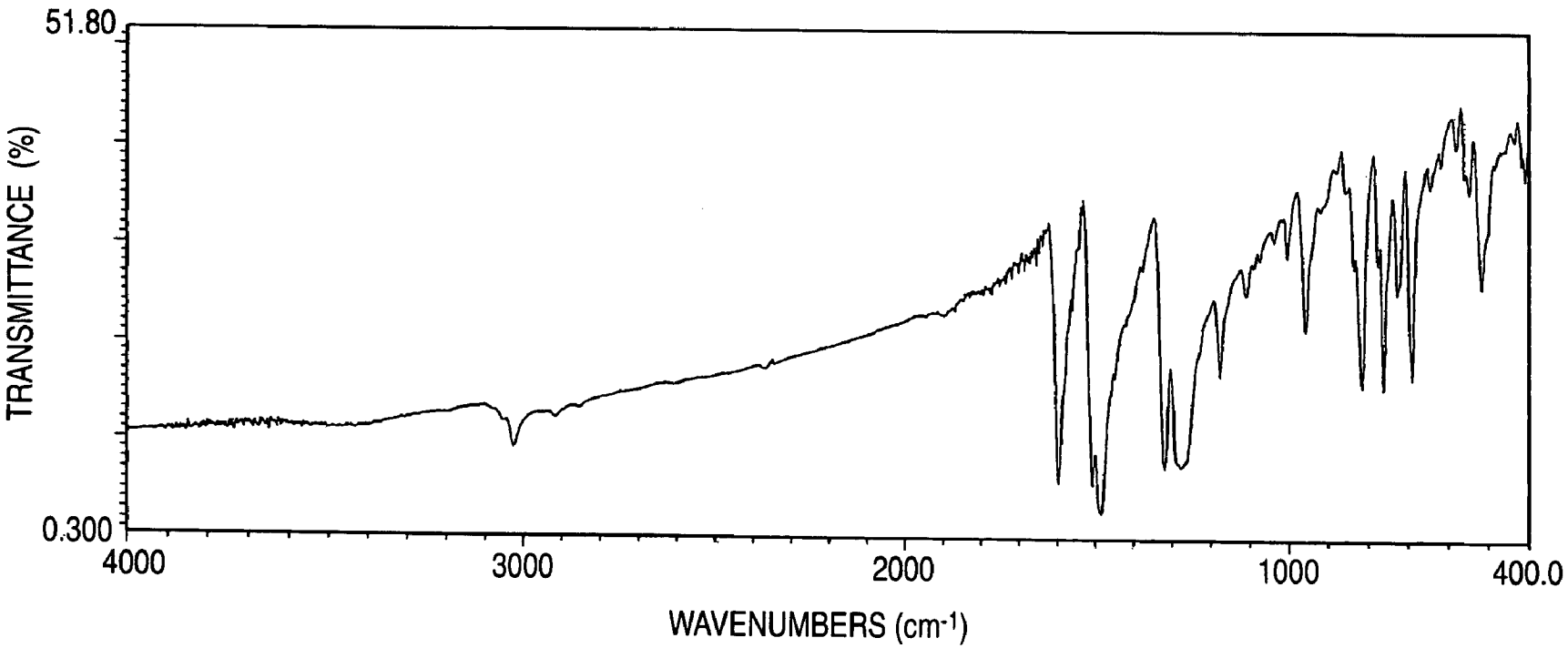
FIG. 6 illustrates an IR spectrum of an arylamine compound obtained in Example 1.

5 parts by weight of the resulting bisformylated compound (B) is added and dissolved in 80 parts by weight of toluene and 4.8 parts by weight of diethyl 3-methylbenzylphosphonate. Thereafter, 2.3 parts by weight of potassium t-butoxide is added thereto, followed by stirring at room temperature for 10 hours. After completing the reaction, 200 mL of toluene and 100 mL of water are added thereto, and insoluble matters are filtered out. The toluene layer is dried and purified by silica gel column chromatography to obtain 6.3 parts by weight of a target arylamine compound (Compound 10 shown in Table 2). An IR spectrum of the compound is shown in FIG. 6.

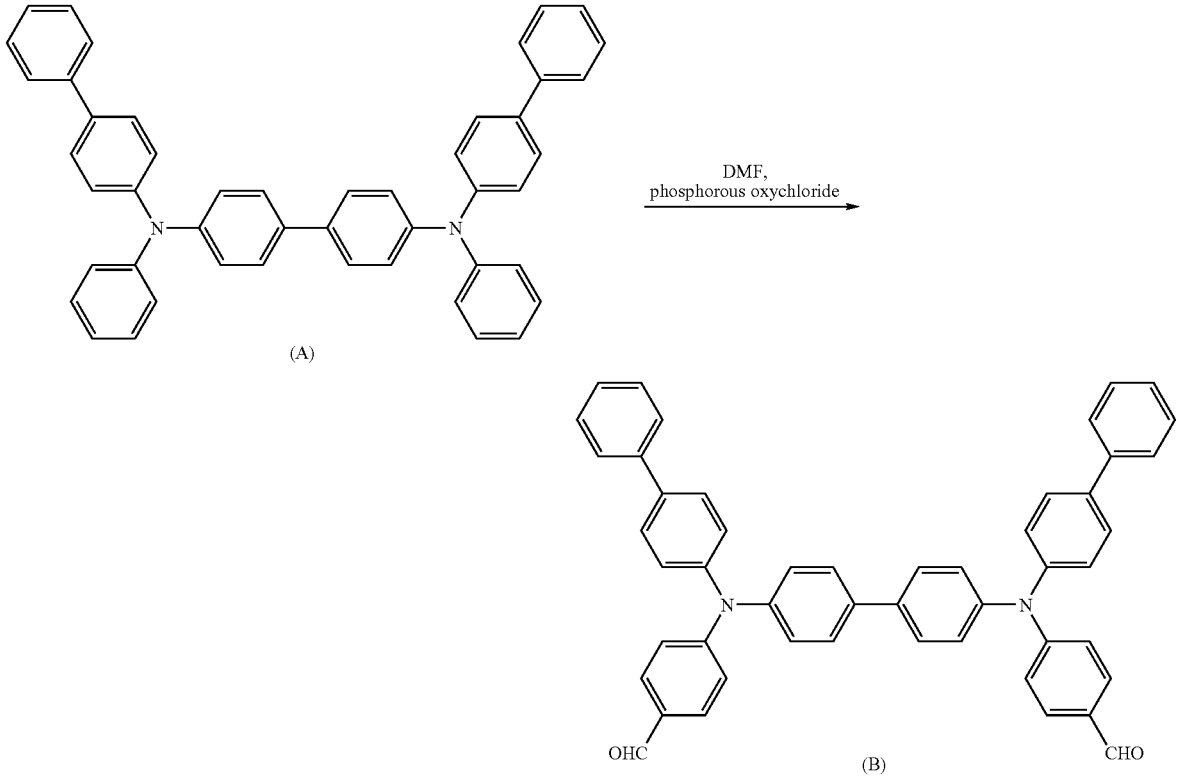

-continued

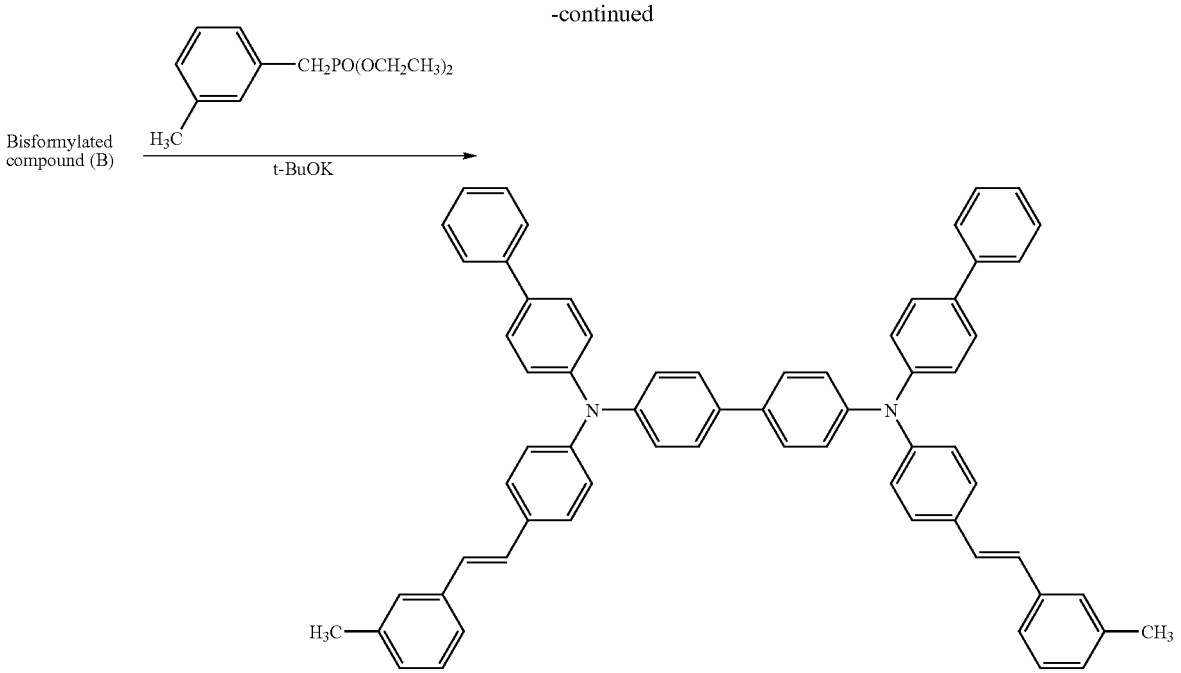

Compound 10

Example 2

Synthesis of Compound 11

Figure 7:
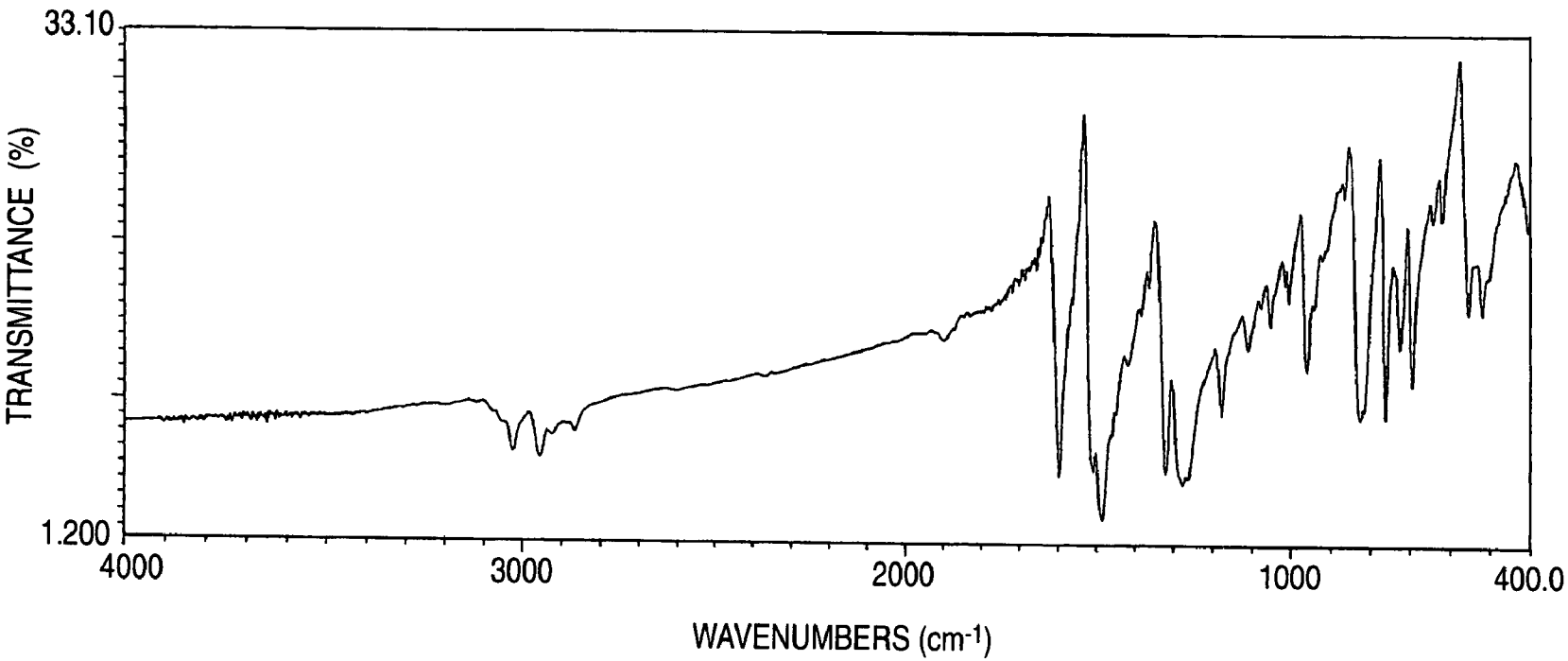
FIG. 7 illustrates an IR spectrum of an arylamine compound obtained in Example 2.

The same synthesis operation as in Example 1 is carried out except that 5.4 parts by weight of diethyl 4-isopropylbenzylphosphonate is used instead of 4.6 parts by weight of diethyl 3-methylbenzylphosphonate in Example 1, so as to obtain 6.5 parts by weight of a target arylamine compound (Compound 11 shown in Table 2). An IR spectrum of the compound is shown in FIG. 7.

Compound 11

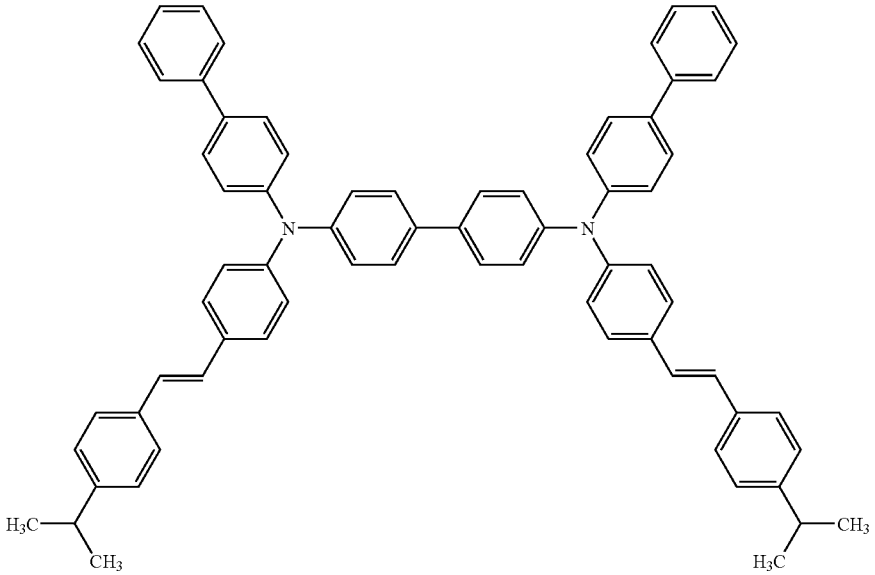

Example 3

Synthesis of Compound 12

Figure 8:
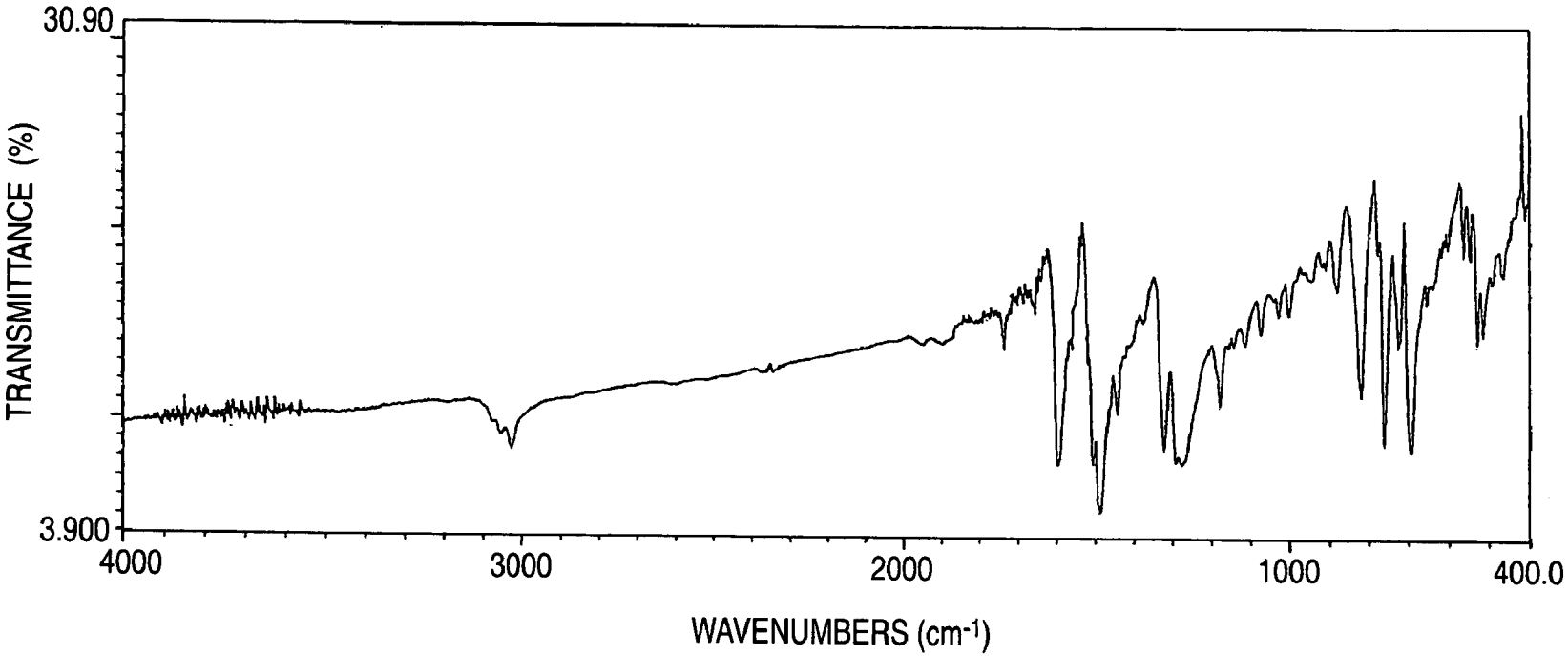
FIG. 8 illustrates an IR spectrum of an arylamine compound obtained in Example 3.

The same synthesis operation as in Example 1 is carried out except that 6 parts by weight of diethyl diphenylmethylphosphonate is used instead of 4.6 parts by weight of diethyl 3-methylbenzylphosphonate in Example 1, so as to obtain 4.9 parts by weight of a target arylamine compound (Compound 12 shown in Table 2). An IR spectrum of the compound is shown in FIG. 8.

Compound 12

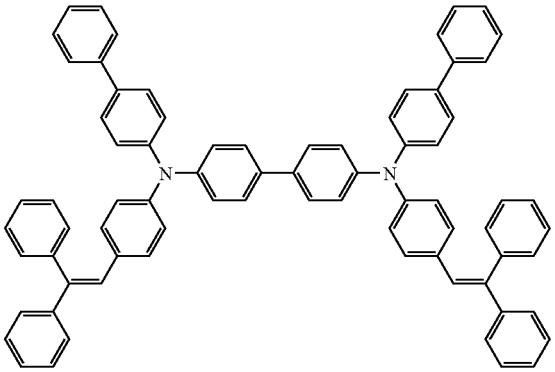

Example 4

Synthesis of Compound 1

Figure 9:
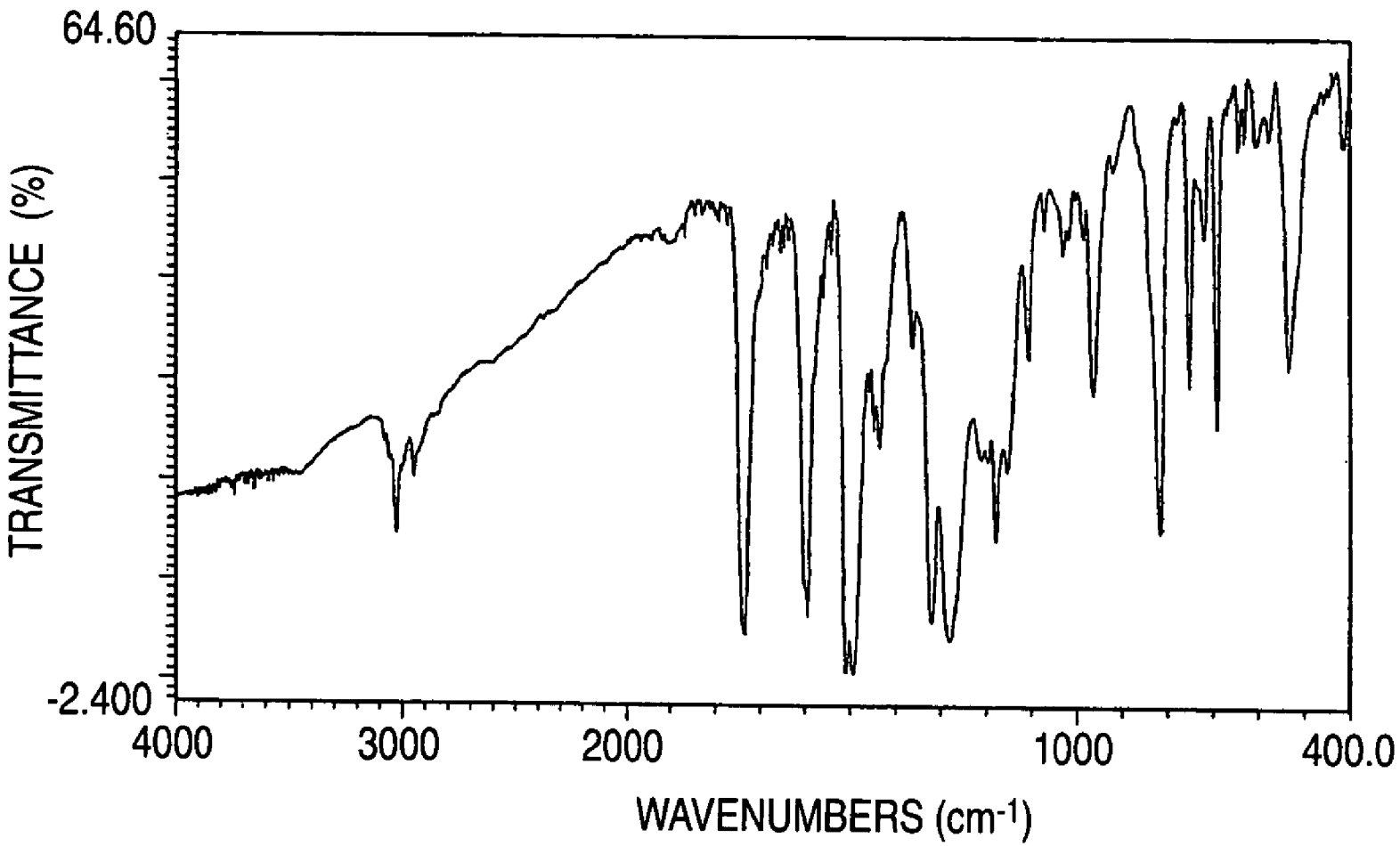
FIG. 9 illustrates an IR spectrum of an arylamine compound obtained in Example 4.

The same bisformylation as in Example 1 is carried out except that the following compound (C) is used instead of the tetraarylbenzidine compound (A), and the resulting formylated compound and diethyl benzylphosphonate are reacted in the same manner as in Example 1, so as to obtain 4.7 parts by weight of a target arylamine compound (Compound 1 shown in Table 1). An IR spectrum of the compound is shown in FIG. 9.

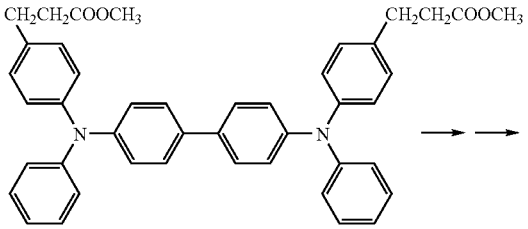

(C)

-continued

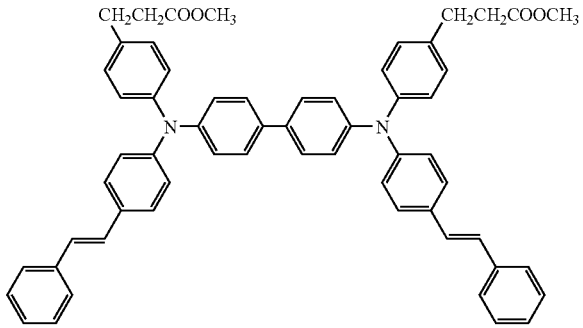

Compound 1

Example 5

Production of Electrophotographic Photoreceptor

A solution containing 10 parts of a zirconium compound (Orgatics ZC540, produced by Matsumoto Chemical Co., Ltd.), 1 part by weight of silane compound (A1110, produced by Nippon Unicar Co., Ltd.), 40 parts by weight of i-propanol and 20 parts by weight of butanol is coated on an aluminum substrate by a dip coating method, and dried at 150° C. for 10 minutes to form an undercoating layer having a thickness of 0.6 μm. 1 part by weight of chlorogallium phthalocyanine crystals having distinct diffraction peaks at 7.4°, 16.6°, 25.5° and 28.3° of Bragg angles (2θ±0.2°) in an X-ray diffraction spectrum is mixed with 1 part by weight of a polyvinyl butyral resin (S-Lec BM-S, produced by Sekisui Chemical Co., Ltd.) and 100 parts by weight of b-butyl acetate, and dispersed in a paint shaker with glass beads for 1 hour, so as to obtain a coating composition. The resulting coating composition is coated on the undercoating layer by a dip coating method, followed by heating and drying at 100° C. for 10 minutes, so as to form a charge generation layer.

2 parts by weight of Compound 10 obtained in Example 1 and 3 parts by weight of a bisphenol (Z) polymer compound having the following structure (viscosity average molecular weight: 40,000) are dissolved in 35 parts by weight of chlorobenzene under heat, and after dissolving, the solution is cooled to room temperature to obtain a coating composition. The coating composition is coated on the charge generation layer by a dip coating method, followed by heating at 110° C. for 60 minutes, so as to obtain a charge transport layer having a thickness of 20 μm.

The electrophotographic photoreceptor thus obtained is evaluated for electrophotographic characteristics in the following manner. By using an electrostatic duplicating paper tester (Electrostatic Analyzer EPA-8100, produced by Kawaguchi Electric Works Co., Ltd.), the electrophotographic photoreceptor is charged by corona discharge of −6 KV under ordinary temperature and humidity condition (at 20° C., 40% RH), and then irradiated with monochrome light obtained from a tungsten lamp by using a monochromater at an intensity of 1 μW/cm$^2$ on the surface of the photoreceptor. The surface voltage $V_0$ (volt) and the half decay exposure amount $E_{1/2}$ (erg/cm$^2$) are measured. The photoreceptor is then irradiated with white light at 10 lux for 1 second, and the residual potential $V_{RP}$ (volt) is measured. After repeating the aforementioned charging and exposure operations in 1,000 times, $V_0$, $E_{1/2}$ and $V_{RP}$ are measured to evaluate variations thereof $\Delta V_0$, $\Delta E_{1/2}$ and $\Delta V_{PR}$ (durability). The evaluation results are shown in Table 9.

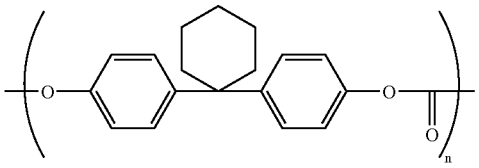

Bisphenol (Z)

Examples 6 to 8

Electrophotographic photoreceptors are produced in the same manner as in Example 5 except that Compound 11, Compound 12 and Compound 1 are used instead of Compound 10 used in Example 5, and evaluated in the same manner as in Example 5. The evaluation results are shown in Table 9. Examples using Compound 11, Compound 12 and Compound 1 are designated as Example 6, Example 7 and Example 8, respectively.

Example 9

An electrophotographic photoreceptor is produced in the same manner as in Example 5 except that hydroxygallium phthalocyanine crystals having distinct diffraction peaks at 7.5°, 9.9°, 12.5°, 16.3°, 18.6°, 25.1° and 28.3° of Bragg angles (2θ±0.2°) in an X-ray diffraction spectrum is used instead of the chlorogallium phthalocyanine crystals used in Example 5, and evaluated in the same manner as in Example 5. The evaluation results are shown in Table 9.

Example 10

The same production procedures as in Example 5 are carried out until the formation of the charge transport layer. 2 parts by weight of the following compound (D), 2 parts by weight of the following compound (E), 0.5 part by weight of tetramethoxysilane and 0.3 part by weight of colloidal silica are dissolved in 5 parts by weight of isopropyl alcohol, 3 parts by weight of tetrahydrofuran and 0.3 part by weight of distilled water, to which 0.5 part by weight of an ion-exchange resin (AMBERLYST 15E) is added, followed by stirring at room temperature for 24 hours, to effect hydrolysis. After filtering out the ion-exchange resin, 0.1 part by weight of aluminum trisacetylacetonate (Al(acac)$_3$) and 0.4 part by weight of 3,5-di-t-butyl-4-hydroxytoluene (BHT) are added to the filtrate to prepare a coating composition. The coating composition is coated on the charge transport layer with a spin coater and then dried in air at room temperature for 30 minutes. The coated layer is then cured by subjecting to a heat treatment at 170° C. for 1 hour to form a protective layer having a thickness of about 3 μm, whereby an electrophotographic photoreceptor is completed. The electrophotographic photoreceptor is evaluated in the same manner as in Example 5. The evaluation results are shown in Table 9.

(D)

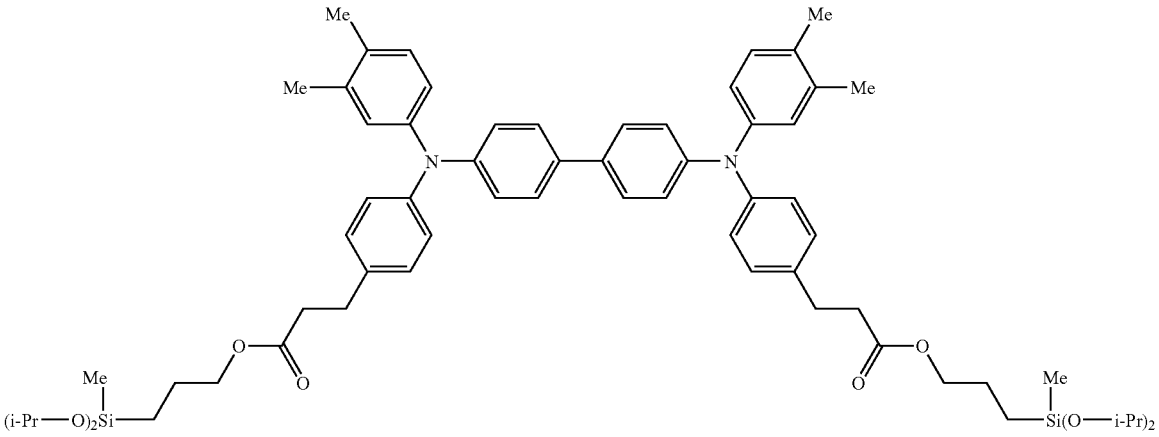

(E)

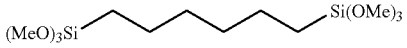

Example 11

An electrophotographic photoreceptor is produced in the same manner as in Example 10 except that the following compound (F) is used instead of the compound (D) used in Example 10, and the following compound (G) is used instead of the compound (E) in Example 10, and evaluated in the same manner as in Example 5. The evaluation results are shown in Table 9.

(F)

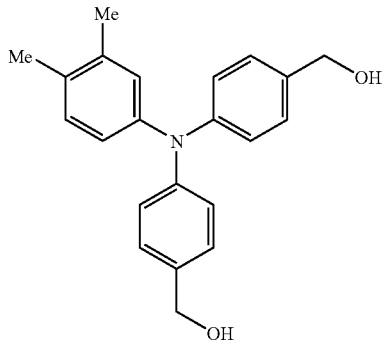

(G)

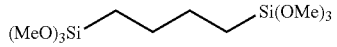

Example 12

The same production procedures as in Example 5 are carried out until the formation of the charge generation layer. 2 parts by weight of Compound 10 used in Example 5 and 3 parts by weight of the bisphenol (Z) polymer compound (viscosity average molecular weight: 40,000) are dissolved in 30 parts by weight of chlorobenzene, to which 0.4 part by weight of Lubron L-2 (produced by Daikin Industries, Ltd.), 0.005 part by weight of Aron GF-300 (produced by Toagosei Co., Ltd.) and 1 mm glass beads are added, followed by dispersing in a paint shaker for 2 hours. The glass beads are filtered out to obtain a coating composition, and the coating composition is coated on the charge generation layer by a dip coating method, followed by heating at 130° C. for 60 minutes, so as to form a charge transport layer having a thickness of 20 μm, whereby an electrophotographic photoreceptor is completed. The electrophotographic photoreceptor is evaluated in the same manner as in Example 5. The evaluation results are shown in Table 9.

Comparative Example 1

An electrophotographic photoreceptor is produced in the same manner as in Example 5 except that the following compound (i) is used instead of Compound 10 used in Example 5, and evaluated in the same manner as in Example 5. The evaluation results are shown in Table 9.

(i)

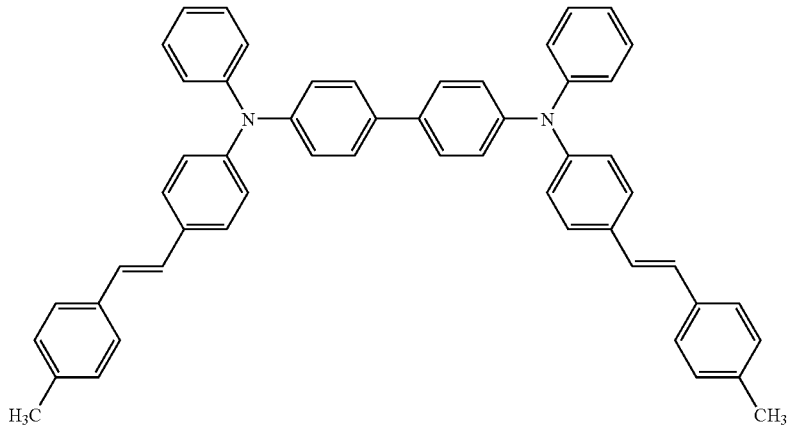

Comparative Example 2

An electrophotographic photoreceptor is produced in the same manner as in Example 5 except that the following compound (ii) is used instead of Compound 10 used in Example 5, and evaluated in the same manner as in Example 5. The evaluation results are shown in Table 9.

(ii)

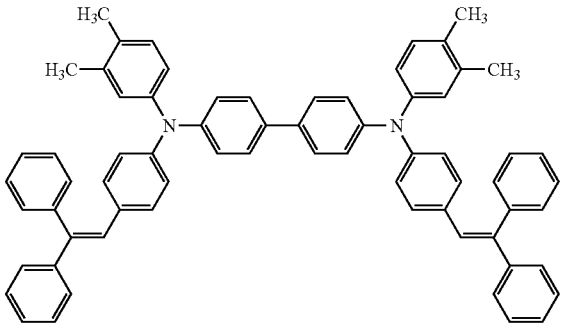

Comparative Example 3

An electrophotographic photoreceptor is tried to produce in the same manner as in Example 5 except that the following compound (iii) is used instead of Compound 10 used in Example 5, but a charge transport layer cannot be formed due to the low solubility of the compound (iii) (benzidine compound), and thus evaluation cannot be carried out.

(iii)

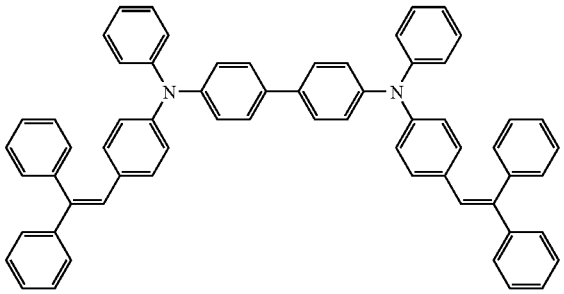

Comparative Example 4

An electrophotographic photoreceptor is produced in the same manner as in Example 5 except that the following compound (iv) is used instead of Compound 10 used in Example 5, and evaluated in the same manner as in Example 5. The evaluation results are shown in Table 9. The compound (iv) is the example compound 1 disclosed in JP-A-7-36203.

(iv)

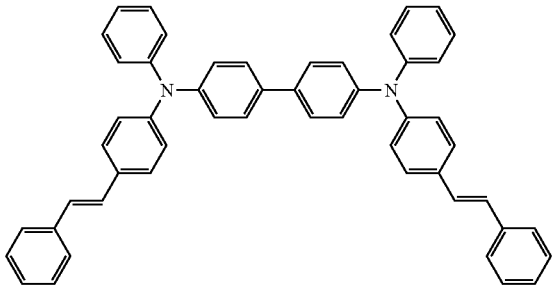

Comparative Example 5

An electrophotographic photoreceptor is produced in the same manner as in Example 5 except that the following compound (v) is used instead of Compound 10 used in Example 5, and evaluated in the same manner as in Example 5. The evaluation results are shown in Table 9. The compound (v) is the example compound 28 disclosed in JP-A-7-36203.

(v)

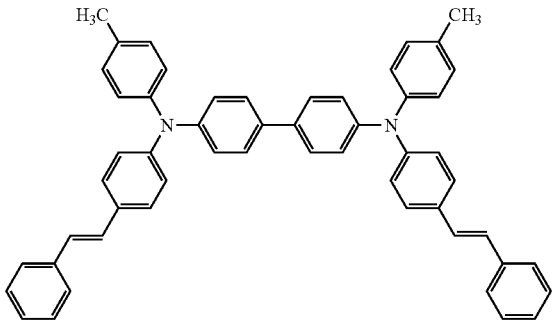

TABLE 9

| | Initial characteristics (first time) | | | Maintained characteristics (1,000th time) | | | Stability | Durability | | |
|---|---|---|---|---|---|---|---|---|---|---|
| | $V_0$ (V) | $E_{1/2}$ (erg/cm$^2$) | $V_{RP}$ (V) | $V_0$ (V) | $E_{1/2}$ (erg/cm$^2$) | $V_{RP}$ (V) | $\Delta E_{1/2}$ (erg/cm$^2$) | $\Delta V_0$ (V) | $\Delta V_{RP}$ (V) | Film forming property (visual observation) |
| Example 5 | −810 | 2.4 | −10 | −795 | 2.8 | −16 | 0.4 | 14 | 6 | good |
| Example 6 | −812 | 2.4 | −11 | −800 | 2.8 | −19 | 0.4 | 12 | 8 | good |
| Example 7 | −809 | 2.4 | −12 | −795 | 2.8 | −20 | 0.4 | 14 | 8 | good |
| Example 8 | −814 | 2.4 | −10 | −802 | 2.8 | −21 | 0.4 | 12 | 11 | good |
| Example 9 | −818 | 2.1 | −9 | −810 | 2.4 | −18 | 0.3 | 8 | 9 | good |
| Example 10 | −825 | 2.5 | −13 | −815 | 2.9 | −24 | 0.4 | 10 | 11 | good |
| Example 11 | −822 | 2.5 | −13 | −811 | 2.9 | −24 | 0.4 | 11 | 11 | good |
| Example 12 | −810 | 2.5 | −14 | −797 | 2.9 | −27 | 0.4 | 13 | 13 | good |
| Comparative Example 1 | −815 | 2.4 | −14 | −798 | 2.8 | −25 | 0.4 | 17 | 15 | good |
| Comparative Example 2 | −822 | 2.4 | −14 | −801 | 2.8 | −31 | 0.4 | 21 | 17 | minute crystals deposited |
| Comparative Example 3 | — | — | — | — | — | — | — | — | — | film could not formed |
| Comparative Example 4 | −810 | 2.4 | −13 | −794 | 2.8 | −31 | 0.4 | 16 | 18 | minute crystals deposited |
| Comparative Example 5 | −816 | 2.4 | −15 | −797 | 2.8 | −30 | 0.4 | 15 | 15 | minute crystals deposited |

What is claimed is:

1. An electrophotographic photoreceptor comprising:

a conductive support; and a photosensitive layer disposed on said conductive support, wherein said photosensitive layer comprises an arylamine compound represented by formula (I):

(I)

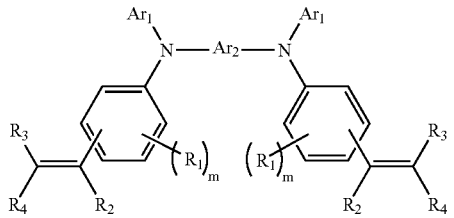

wherein:

$Ar_1$ represents a phenyl group substituted by —$R_5$—COO—$R_6$, a substituted or unsubstituted monovalent polycyclic aromatic hydrocarbon group, and a substituted or unsubstituted monovalent heterocyclic group;

$Ar_2$ represents a substituted or unsubstituted arylene group;

$R_1$ represents a hydrogen atom, a halogen atom, an alkoxy group, or a substituted or unsubstituted alkyl group;

$R_2$ represents a hydrogen atom, a substituted or unsubstituted alkyl group, or a substituted or unsubstituted aryl group;

$R_3$ and $R_4$ each independently represents a hydrogen atom, a substituted or unsubstituted alkyl group, or a substituted or unsubstituted aryl group, at least one of $R_3$ and $R_4$ represents a substituted or unsubstituted aryl group, and $R_3$ and $R_4$ may be bound to form a ring via a single bond or a divalent group;

$R_5$ represents an alkylene group having 1 to 4 carbon atoms;

$R_6$ represents an alkyl group having 1 to 4 carbon atoms; and m represents an integral of from 0 to 4.

2. The electrophotographic photoreceptor according to claim 1, wherein said substituted or unsubstituted monovalent polycyclic aromatic hydrocarbon group is a substituted or unsubstituted monovalent condensed-ring polycyclic hydrocarbon group, or a biphenyl group which may be substituted by a substituted or unsubstituted phenyl group, an alkyl group having 1 to 4 carbon atoms, an alkoxy group having 1 to 4 carbon atoms or a halogen atom.

3. The electrophotographic photoreceptor according to claim 1, wherein said substituted or unsubstituted monovalent heterocyclic group is a substituted or unsubstituted monovalent condensed-ring heterocyclic group, or a monovalent heterocyclic compound group in which at least one 3- to 6-membered heterocyclic ring and at least one benzene ring are bound via a single bond or a divalent group.

4. The electrophotographic photoreceptor according to claim 1, wherein said substituted or unsubstituted arylene group is a substituted or unsubstituted phenylene group, a substituted or unsubstituted divalent condensed-ring polycyclic hydrocarbon group, a substituted or unsubstituted divalent condensed-ring heterocyclic group, or a divalent group in which two substituted or unsubstituted phenyl groups are bound via a single bond or a divalent group.

5. The electrophotographic photoreceptor according to claim 1, wherein the arylamine compound is represented by formula (I-1):

(I-1)

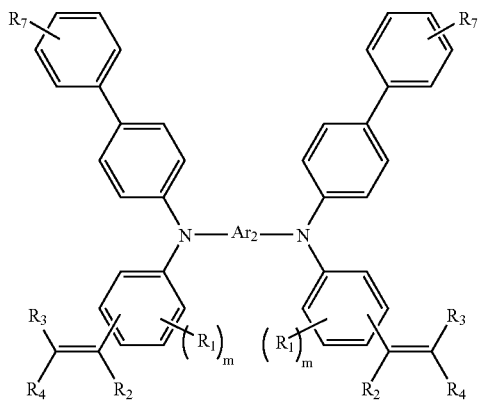

wherein:

$Ar_2$ represents a substituted or unsubstituted arylene group;

$R_1$ represents a hydrogen atom, a halogen atom, an alkoxy group, or a substituted or unsubstituted alkyl group;

$R_2$ represents a hydrogen atom, a substituted or unsubstituted alkyl group, or a substituted or unsubstituted aryl group;

$R_3$ and $R_4$ each independently represents a hydrogen atom, a substituted or unsubstituted alkyl group, or a substituted or unsubstituted aryl group, at least one of $R_3$ and $R_4$ represents a substituted or unsubstituted aryl group, and $R_3$ and $R_4$ may be bound to form a ring via a single bond or a divalent group;

$R_7$ represents a hydrogen atom, a halogen atom, an alkoxy group, or a substituted or unsubstituted alkyl group; and m represents an integral of from 0 to 4.

6. The electrophotographic photoreceptor according to claim 5, wherein said substituted or unsubstituted arylene group is a substituted or unsubstituted phenylene group, a substituted or unsubstituted divalent condensed-ring polycyclic hydrocarbon group, a substituted or unsubstituted divalent condensed-ring heterocyclic group, or a divalent group in which two substituted or unsubstituted phenyl groups are bound via a single bond or a divalent group.

7. An electrophotographic photoreceptor comprising:

a conductive support; and a photosensitive layer disposed on said conductive support and including a charge generation layer and a charge transport layer, wherein said charge transport layer comprises an arylamine compound represented by formula (I):

(I)

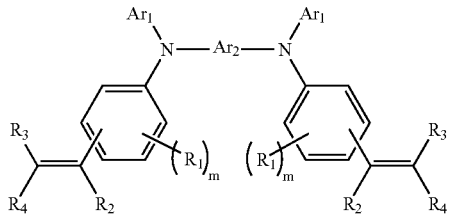

wherein:

$Ar_1$ represents a phenyl group substituted by —$R_5$—COO—$R_6$, a substituted or unsubstituted monovalent polycyclic aromatic hydrocarbon group, and a substituted or unsubstituted monovalent heterocyclic group;

$Ar_2$ represents a substituted or unsubstituted arylene group;

$R_1$ represents a hydrogen atom, a halogen atom, an alkoxy group, or a substituted or unsubstituted alkyl group;

$R_2$ represents a hydrogen atom, a substituted or unsubstituted alkyl group, or a substituted or unsubstituted aryl group;

$R_3$ and $R_4$ each independently represents a hydrogen atom, a substituted or unsubstituted alkyl group, or a substituted or unsubstituted aryl group, at least one of $R_3$ and $R_4$ represents a substituted or unsubstituted aryl group, and $R_3$ and $R_4$ may be bound to form a ring via a single bond or a divalent group;

$R_5$ represents an alkylene group having 1 to 4 carbon atoms;

$R_6$ represents an alkyl group having 1 to 4 carbon atoms; and m represents an integral of from 0 to 4.

8. The electrophotographic photoreceptor according to claim 7, said charge generation layer comprises at least one charge generation material selected from the group consisting of chlorogallium phthalocyanine, hydroxygallium phthalocyanine, and oxytitanium phthalocyanine.

9. The electrophotographic photoreceptor according to claim 1, further comprising a protective layer disposed on said photosensitive layer.

10. The electrophotographic photoreceptor according to claim 9, wherein said protective layer includes a siloxane based resign which has a charge transporting property and a cross-linking structure.

11. An image forming apparatus comprising:

an electrophotographic photoreceptor comprising:

a conductive support; and a photosensitive layer disposed on said conductive support, wherein said photosensitive layer comprises an arylamine compound represented by formula (I):

(I)

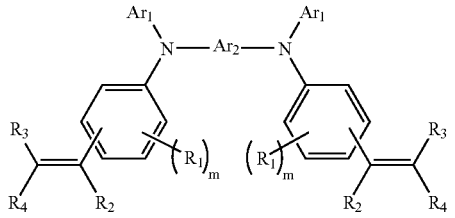

wherein $Ar_1$ represents a phenyl group substituted by —$R_5$—COO—$R_6$, a substituted or unsubstituted monovalent polycyclic aromatic hydrocarbon group, and a substituted or unsubstituted monovalent heterocyclic group;

$Ar_2$ represents a substituted or unsubstituted arylene group;

$R_1$ represents a hydrogen atom, a halogen atom, an alkoxy group, or a substituted or unsubstituted alkyl group;

$R_2$ represents a hydrogen atom, a substituted or unsubstituted alkyl group, or a substituted or unsubstituted aryl group;

$R_3$ and $R_4$ each independently represents a hydrogen atom, a substituted or unsubstituted alkyl group, or a substituted or unsubstituted aryl group, at least one of $R_3$ and $R_4$ represents a substituted or unsubstituted aryl group, and $R_3$ and $R_4$ may be bound to form a ring via a single bond or a divalent group;

$R_5$ represents an alkylene group having 1 to 4 carbon atoms;

$R_6$ represents an alkyl group having 1 to 4 carbon atoms; and m represents an integral of from 0 to 4;

a charging unit which charges said electrophotographic photoreceptor;

an exposure unit which exposes said charged electrophotographic photoreceptor to form an electronic latent image;

a developing unit which develops said electronic latent image to form a toner image; and a transferring unit which transfers said toner image to a recording medium.

12. A process cartridge comprising:

an electrophotographic photoreceptor comprising:

a conductive support; and a photosensitive layer disposed on said conductive support, wherein said photosensitive layer comprises an arylamine compound represented by formula (I):

(I)

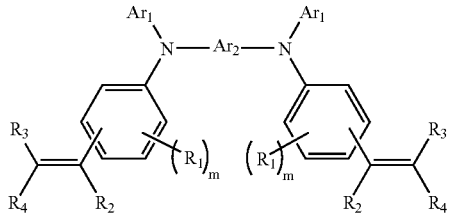

wherein:

$Ar_1$ represents a phenyl group substituted by —$R_5$—COO—$R_6$, a substituted or unsubstituted monovalent polycyclic aromatic hydrocarbon group, and a substituted or unsubstituted monovalent heterocyclic group;

$Ar_2$ represents a substituted or unsubstituted arylene group;

$R_1$ represents a hydrogen atom, a halogen atom, an alkoxy group, or a substituted or unsubstituted alkyl group;

$R_2$ represents a hydrogen atom, a substituted or unsubstituted alkyl group, or a substituted or unsubstituted aryl group;

$R_3$ and $R_4$ each independently represents a hydrogen atom, a substituted or unsubstituted alkyl group, or a substituted or unsubstituted aryl group, at least one of $R_3$ and $R_4$ represents a substituted or unsubstituted aryl group, and $R_3$ and $R_4$ may be bound to form a ring via a single bond or a divalent group;

$R_5$ represents an alkylene group having 1 to 4 carbon atoms;

$R_6$ represents an alkyl group having 1 to 4 carbon atoms; and m represents an integral of from 0 to 4; and at lease one unit selected from the group consisting of a charging unit which charges said electrophotographic photoreceptor, an exposure unit which exposes said charged electrophotographic photoreceptor to form an electronic latent image, and a cleaning unit which cleans said electrophotographic photoreceptor.

* * * * *